United States Patent [19]

Washio et al.

[11] 4,012,138

[45] Mar. 15, 1977

[54] ELECTROSTATIC PHOTOGRAPHIC COPYING APPARATUS

[75] Inventors: Takaji Washio, Toyonaka; Tatsuo Aizawa, Osaka, both of Japan

[73] Assignee: Mita Industrial Company, Ltd., Osaka, Japan

[22] Filed: Nov. 26, 1973

[21] Appl. No.: 419,047

[30] Foreign Application Priority Data

Nov. 30, 1972 Japan ..... 47-120246

[52] U.S. Cl. ..... 355/8; 355/14; 355/51

[51] Int. Cl.[2] ..... G03G 15/30

[58] Field of Search ..... 355/3 R, 8, 11, 14, 355/17, 15, 16, 50, 51, 3

[56] References Cited

UNITED STATES PATENTS

| | | | |
|---|---|---|---|
| 3,399,610 | 9/1968 | Eichorn | 355/14 X |
| 3,554,640 | 1/1971 | Hoskins | 355/8 |
| 3,647,293 | 3/1972 | Queener | 355/15 |
| 3,697,169 | 10/1972 | Maksymiak et al. | 355/14 |
| 3,751,158 | 8/1973 | Komori | 355/8 |
| 3,819,261 | 6/1974 | Ogawa | 355/14 |

*Primary Examiner*—L. T. Hix
*Assistant Examiner*—Kenneth C. Hutchison
*Attorney, Agent, or Firm*—Sherman & Shalloway

[57] ABSTRACT

An electrostatic photographic copying apparatus wherein the image-forming device, the optical device, the transfer device and the transfer paper transferring device are controlled according to the rotation of the rotary drum so that one cycle of the copying operation is completed while the rotating drum, equipped with a photosensitive element on which to form an image, is rotated through two turns. Substantially the entire surface of the rotary drum can be utilized as an image-forming area by rotating the rotary drum through two turns in one cycle of the copying operation.

12 Claims, 18 Drawing Figures

1
2
3
4
5
6
8
9
10
11
12
12'
13
14
15
16
17
18
19
20
21
22
23
23'
24
25
26
27
28
29
30
30'
31
31'
32
33
34
35a
35'a
35b
35'b
35c
35'c
35d
35'd
35e
35'e
35f
35'f
36
36'
37
38
39
40
41
42
43
44
45
45'
46
47
48
49
50
51
52
53
53'
54
55
a
b'
b"
CL
L
C4
C5
P2

Fig. 2-A
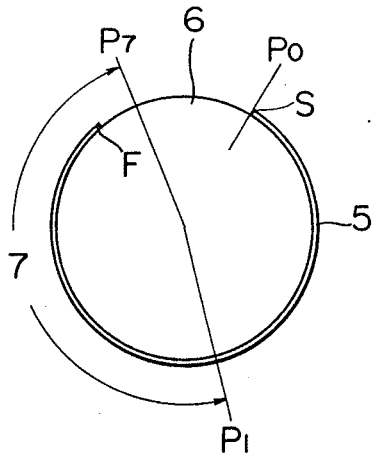
Fig. 2-B
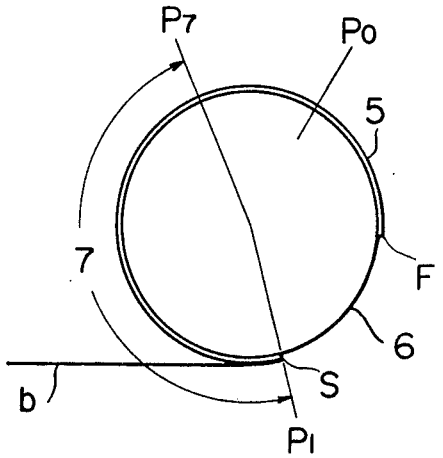
Fig. 2-C
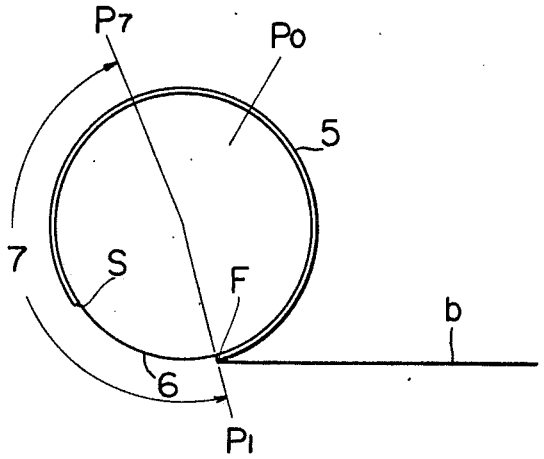

Lmax+W
LA
P10
Sa
P12
P9
Pa
3
S10
97
41
42
5
96
Po
6
101
P6
P3
2
C3
C2
S8
116
L2
99
100
M1
M2
95
94
93
96'
S9
1
b'
97
30
30'
C4
b''
23
53
53'
C5
P5
S7
32
96''
P2
13
L2'
S6
P1'
P1
37
92
44
45
S11
39
98
P4
Lx'
40
48
TH
47
49
45'
46
50

Fig. 5-A
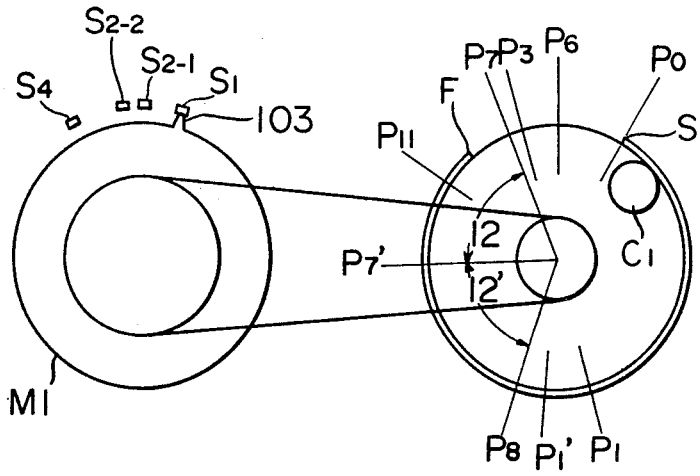
Fig. 5-B
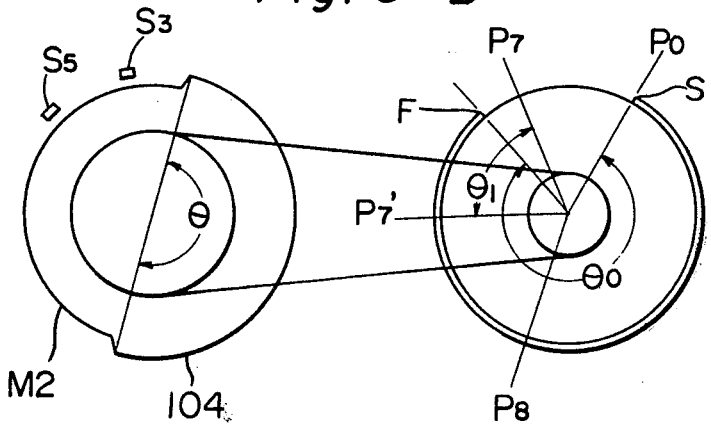

Fig. 11-A

Fig. 11-B
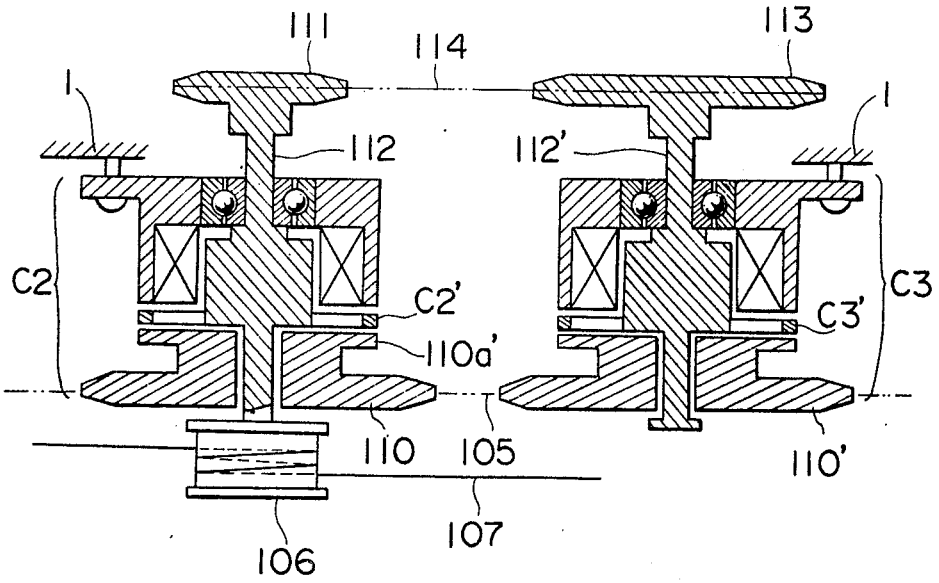
Fig. 12
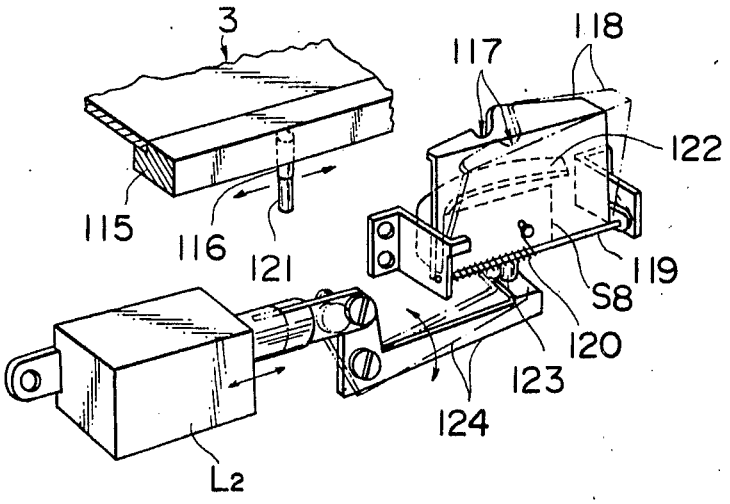

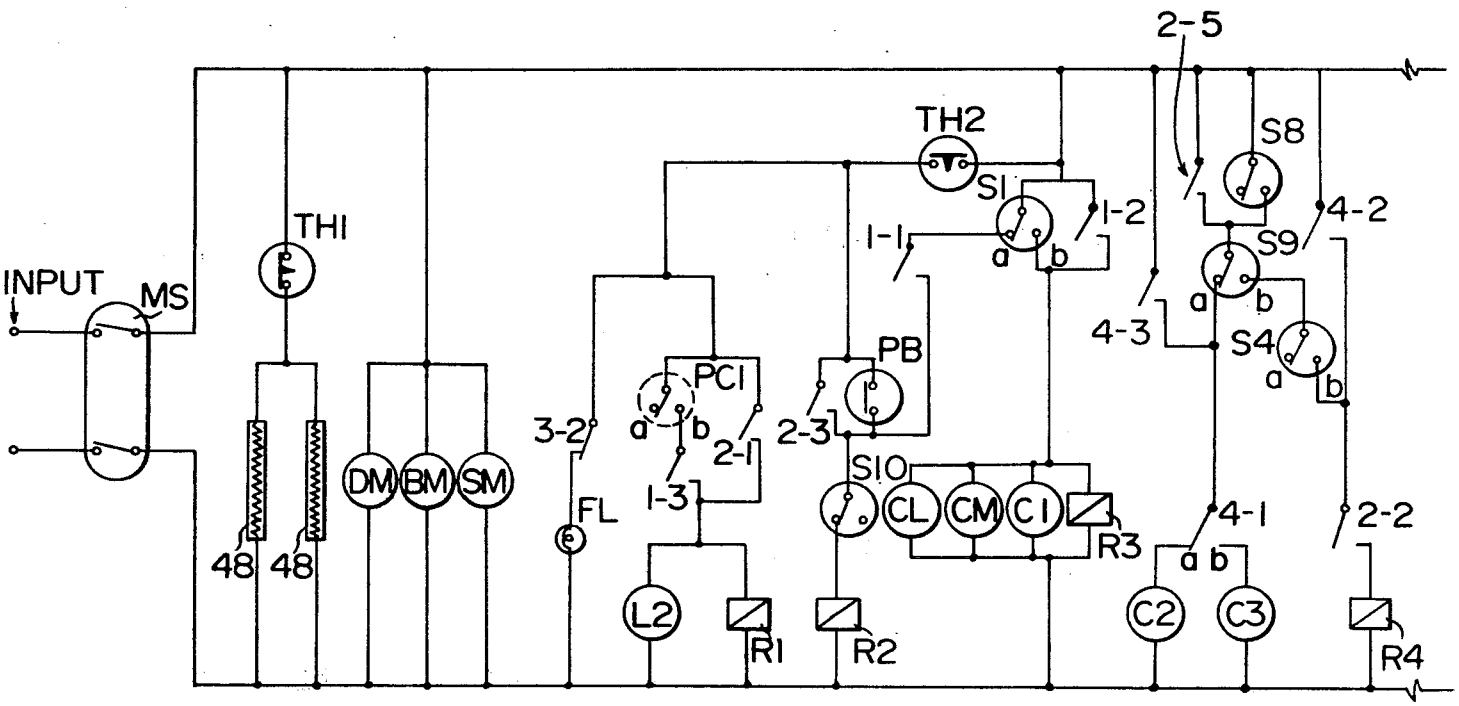
Fig. 13-A

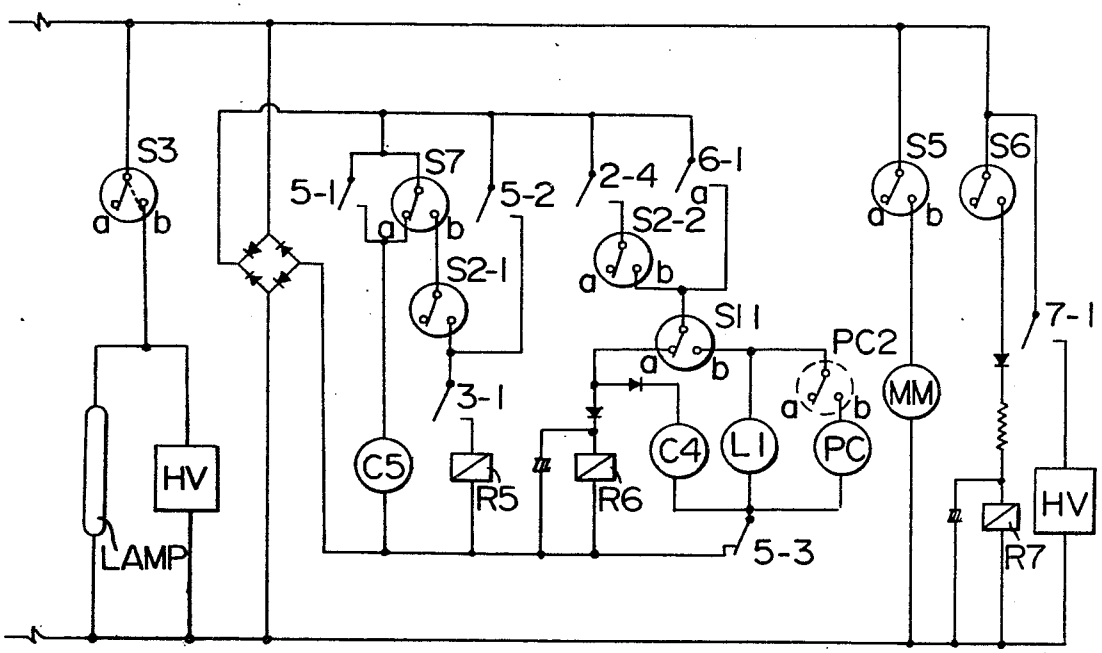
Fig. 13-B

ELECTROSTATIC PHOTOGRAPHIC COPYING APPARATUS

BACKGROUND OF THE INVENTION

1. Field of the Invention

This invention relates to an electrostatic photographic copying apparatus, and more specifically, to an electrostatic photographic copying apparatus of such a construction that a one-cycle copying operation is completed while a rotary drum equipped with a photosensitive element rotates through two turns.

2. Technical Considerations and Prior Art

The conventional electrostatic photographic copying apparatus equipped with a rotary drum are constructed such that a one-cycle copying operation is completed while the rotary drum rotates once. In an electrostatic photographic copying apparatus of this type, an image-forming zone for forming an image on the rotary drum and a transfer zone for transferring the image formed on the rotary drum to a transfer paper are disposed along the outer periphery of the rotary drum, and the copying operation begins when the forwarding end point of the area of photosensitive drum where an image is to be formed is located at a predetermined position upstream of the image-forming zone, and completes when the rotary drum has rotated once. It is necessary at this time that the rear end of the image-forming area of the rotary drum passes the transfer zone when the copying operation has ended. For this reason, the peripheral surface of the rotary drum can be utilized as an image-forming area only at a portion corresponding to the length which is equal to the distance between the downstream end of the transfer zone and the above-mentioned standard position upstream of the image-forming zone in the rotating direction of the rotary drum. In other words, the area on the peripheral surface having a length corresponding to the distance between the standard position upstream of the image-forming zone to the downstream end of the transfer zone in the rotating direction of the rotating drum cannot be utilized as an image-forming area. Thus, in such a type of copying machine, a photosensitive element is attached to the rotary drum to cover about the half of the peripheral length, and forms an image-forming area. This makes it necessary to use a rotary drum of larger diameter to obtain the desired maximum copying length (the length of the image-forming area), and constitutes a setback against the provision of a compact copying machine.

In an attempt to remove such defects, consideration may be given to a system wherein an endless photosensitive layer is provided on the entire surface of the rotary drum, and the rotary drum is started from any desired angular position and rotated by an angle corresponding to the desired copying length. According to this method, however, the angular position of the rotary drum at the time of initiating the copying operation and the angular position of the rotary drum at the completion of the copying operation are not constant, but vary at random. Thus, the control mechanism for the start of supply of transfer paper and its cutting, and the exposure of the original which are all performed in synchronization with the rotary drum becomes very complicated. Furthermore, the provision of an endless and jointless photosensitive layer on the rotary drum is generally costly.

SUMMARY OF THE INVENTION

It is an object of this invention to provide an electrostatic photographic copying apparatus in which the individual devices are controlled such that a one-cycle copying operation completes while a rotary drum provided with a photosensitive element on its peripheral surface rotates through two turns, and an area on the surface of the rotary drum which has a larger length than the distance from the downstream end of the transfer zone to the standard position upstream of the image-forming zone in the rotating direction of the rotary drum can be utilized as an image-forming area.

Another object of this invention is to provide a compact copying apparatus in which a rotary drum of a very small diameter can be used without reducing the maximum copying length as compared with an electrostatic photographic copying apparatus of the conventional type wherein a once-cycle copying operation is performed while the rotary drum rotates once.

Still another object of this invention is to provide a transfer-type electrostatic photographic copying apparatus in which not only an endless photosensitive element but also a photosensitive element having ends can be used.

Still another object of the invention is to provide an electrostatic photographic copying apparatus equipped with a control mechanism of a relatively simple construction in which the supply of transfer paper is controlled according to the rotation of the drum and the rotary drum is synchronized with the transfer paper.

Still another object of the invention is to provide an electrostatic photographic copying apparatus equipped with a device for cutting a roll of transfer paper exactly to the desired copying length.

Still another object of this invention is to provide an electrostatic photographic copying apparatus equipped with a control device of a relatively simple construction in which the exposure of an original is started when the forward end of the image-forming area has reached in its first rotation to an exposing opening provided around the rotary drum.

A further object of this invention is to provide an electrostatic photographic copying apparatus equipped with a control device of a relatively simple construction whereby the rotary drum is stopped when it has just rotated through two turns.

According to this invention, there is provided an electrostatic photographic copying apparatus comprising a rotary drum equipped with an electrostatic photosensitive element on at least a part of its peripheral surface, an image-forming section disposed along the periphery of the rotary drum for forming on the photosensitive element an electrostatic latent image corresponding to an original or a developed image corresponding to the electrostatic latent image, an optical device for projecting the image of the original on the photosensitive element on the rotary drum through an exposing opening included within the image-forming zone, an image-transferring device disposed downstream of the image-forming device along the periphery of the rotary drum, and a forwarding device for feeding transfer paper to the image-transferring device; characterized in that said apparatus further includes means for controlling said devices such that in each cycle of copying operation, the rotary drum is started to be rotated from an angular position at which the forward end point (S) of an area of image formation on its peripheral surface coincides with a predetermined standard position ($P_o$) upstream of the image-forming zone, and a one-cycle of copying operation is completed while the rotary drum rotates through two turns, the length from the forward end point (S) of said area of image formation to the rear end point (F) of said area being larger than the distance between the downstream end position ($P_1$) of the transfer zone to the standard position ($P_o$) in the rotating direction of the rotary drum, and thus, the maximum copyable length being larger than the distance from the position ($P_1$) to the standard position ($P_o$) in the rotating direction of the rotary drum.

The present invention can be applied to an electrostatic photographic copying apparatus of any desired type wherein the apparatus includes a rotary drum, and transfer paper is unwound from a roll of transfer paper and brought into contact with the rotary drum, and the resulting image is transferred from the rotary drum to the transfer paper. For example, the present invention can equally be applied to a "copying original transfer slit exposure type" copying apparatus in which the original is placed on a transparent plate provided movably on the apparatus and an optical system is fixed within the apparatus, or a "optical system moving exposure type" copying apparatus in which an original is placed on a transparent plate fixed on the apparatus and slit exposure is performed while an optical system moves. The invention can also be applied to an electrostatic image transfer copying machine wherein an electrostatic image is formed on the surface of a photosensitive element on a rotary drum and transferred to transfer paper, and then the image is turned into a visible one, or a toner image transfer type copying apparatus in which an electrostatic image is formed on the surface of a rotary drum, then developed with a toner, then transferred onto transfer paper, and if desired, fixed.

The invention is also applicable to other types of copying apparatus in which an automatic paper supply is performed by attaching a box or cartridge for accommodating a sheet of transfer paper to one end wall of the apparatus, or a sheet of transfer paper is inserted in the apparatus by hand and supplied to a passageway for transferring transfer paper.

The present invention will be described below with reference to a specific embodiment in which the invention is applied to a copying apparatus of the copying original transfer exposure and toner image transfer types, but is in no way limited to the specific embodiment.

This invention will be illustrated in detail by reference to the embodiments shown in the accompanying drawings in which:

FIG. 1 is a view showing the outline of the arrangement of a copying apparatus in accordance with this invention;

FIGS. 2–A, 2–B and 2–C are views illustrating the theory of this invention;

FIGS. 3 and 4 are arrangement views illustrating the theory of the copying apparatus of this invention;

FIGS. 5–A and 5–B are views showing the arrangement of control means used in the copying apparatus of this invention;

Figure 11:
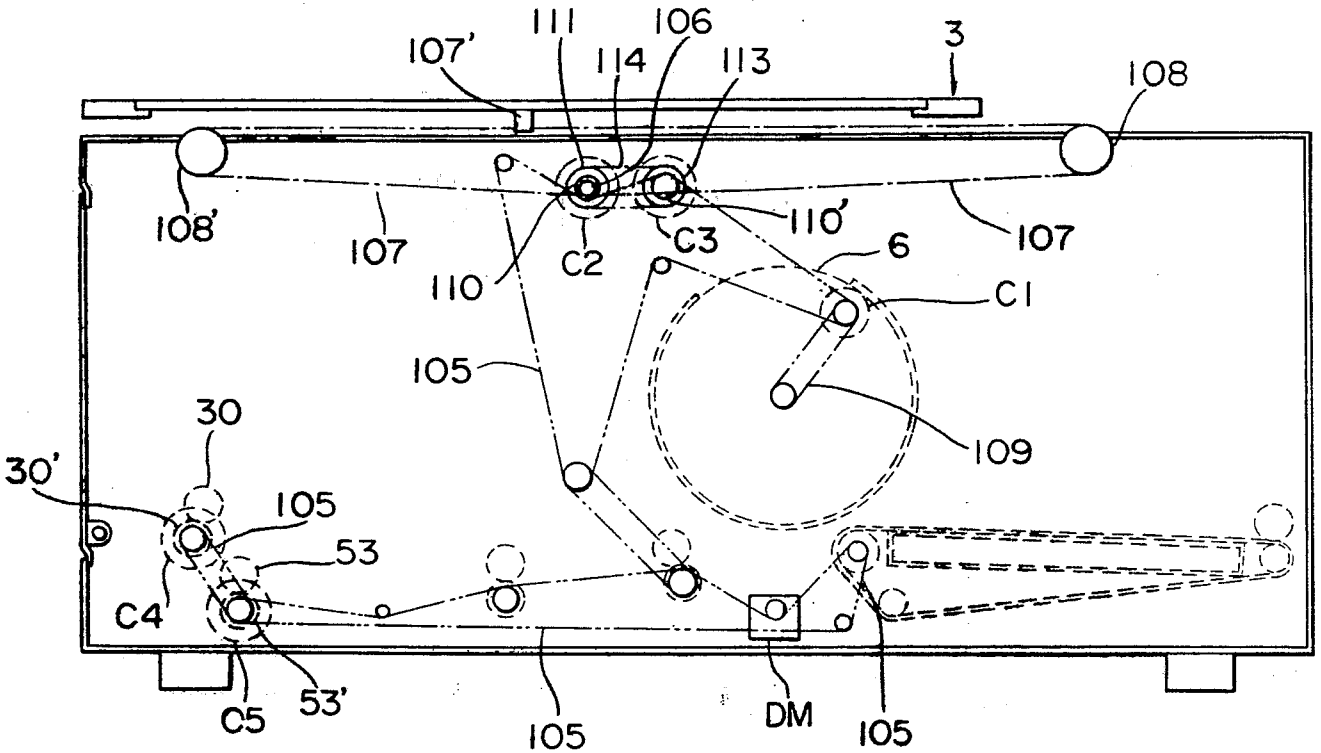

FIG. 11-A is a view showing the arrangement of a drive system for use in the copying apparatus of this invention;

FIG. 11-B is a sectional view showing a drive system for a moving frame;

FIG. 12 is a perspective view showing a restraint mechanism for the moving frame; and FIG. 13 is a circuit of the apparatus in accordance with the present invention.

ENTIRE STRUCTURE

Figure 1:
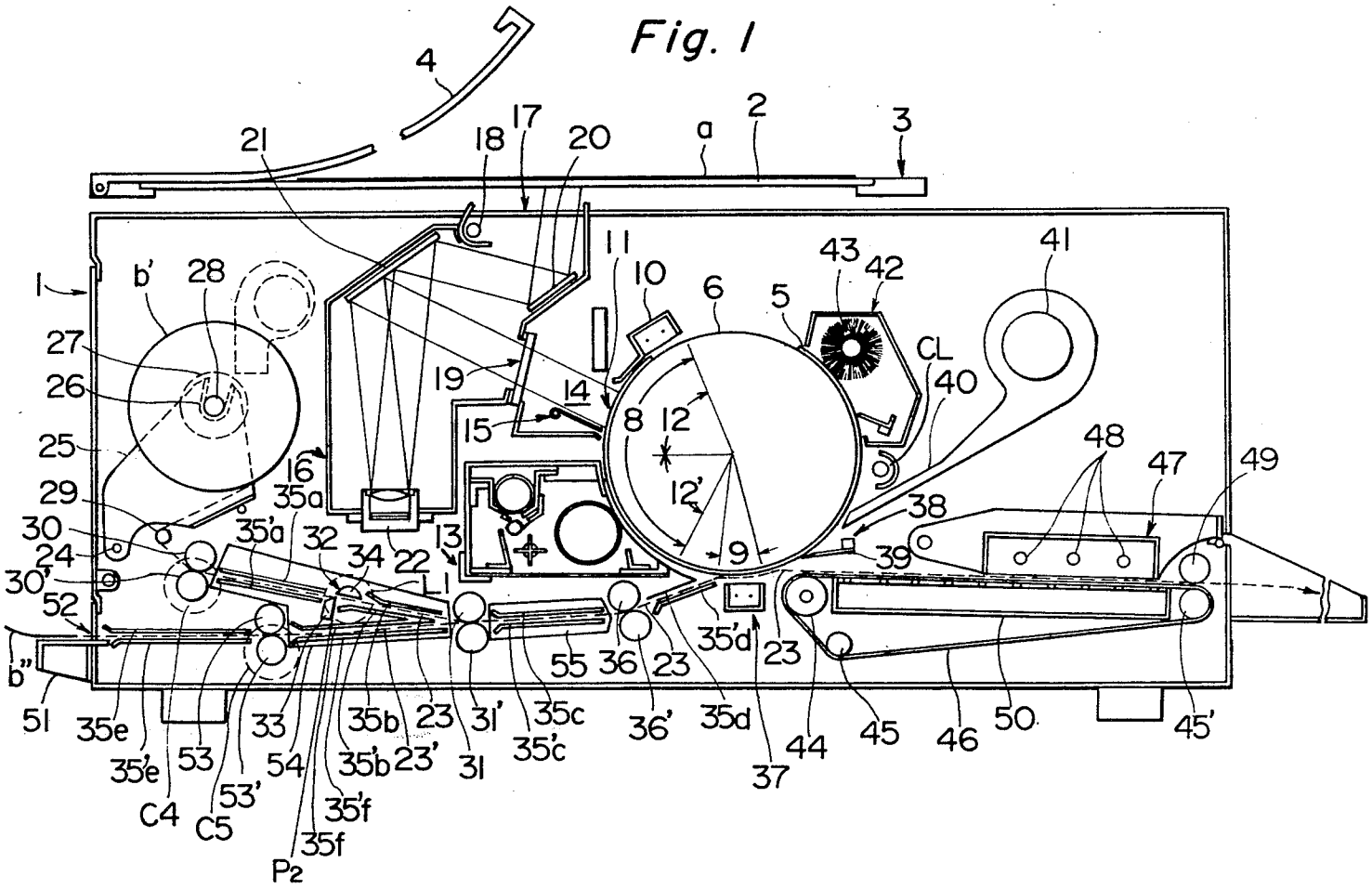

In FIG. 1 illustrating an outline of the entire arrangement in the electrostatic photographic copying apparatus of this invention, a transparent plate 2 is mounted in the upper portion of a housing 1 to support thereon an original *a* to be copied. This transparent plate 2 is supported by a moving frame 3 capable of moving reciprocatingly in the horizontal direction and an original-pressing flexible plate 4 is attached to the moving frame 3 so that it can cover the transparent plate 2.

In the interior of the housing 1, a rotary drum 6 having on the surface thereof an electrostatic photosensitive element 5 is rotatably mounted. This photosensitive element 5 may be any of a monolayer photosensitive plate formed by applying an inorganic photoconductor such as selenium, zinc oxide, cadmium sulfide, or cadmium selenide or an organic photoconductor such as polyvinyl carbazole, optionally together with a binder, on a substrate such as a metal plate or a paper rendered electrically conductive, a multilayer photosensitive plate formed by laminating a plurality of photoconductor layers or a sandwich-type multilayer photosensitive plate formed by inserting a photoconductor layer between an insulator layer and a conductor layer.

An image-forming zone 8 in which an image-forming device is to be disposed and a transfer zone 9 in which a transfer device is to be disposed are arranged along the circumference of the rotary drum 6. The embodiment shown in FIG. 1 is suitable for a system wherein a photosensitive element 5 composed of a photoconducting layer and an electrically conducting layer is provided on the rotary drum 6, and a toner image is formed thereon and then transferred to transfer paper. The image-forming zone 8 consists of a charging device for charging the surface of the photosensitive element 5 in a specific polarity, an electrostatic image forming zone 12 containing an exposing opening 11 for exposing an image on the surface of the photosensitive element 5, and a developing zone 12' in which a development device 13 is disposed for developing an electrostatic latent image formed on the photosensitive element with toner powder. The charging device 10 includes a corona wire to which high potential is to be applied, and the photosensitive element 5 is charged by a corona discharge from its electrode. The exposing opening 11 is provided with a light amount adjusting device (reduction device) for adjusting the width of an optical passage 14 from the optical system 16.

When a multilayered photosensitive element consisting of an insulating layer, a light conducting layer and an electrically conducting layer is used in place of the above-mentioned monolayer photosensitive element, the above-mentioned electrostatic latent image forming zone 12 consists of a precharging device for erasing the residual charge on the surface of the photosensitive element, a primary charging device for charging the surface of the photosensitive element in a specific polarity, a secondary charging and simultaneously exposing device for secondarily charging the primarily charged photosensitive element while exposing it imagewise, and a device for uniformly exposing the entire surface of the photosensitive element which has been secondarily charged and exposed imagewise. The potential to be applied to the corona wire of the secondary and simultaneously exposing device may either be a direct current potential having an opposite polarity to that of the primary charging, an alternate current potential, or asymmetric alternate current potential.

In the present invention, any desired electrostatic image-forming treating zone can be used which consists of various combinations of a charging mechanism and an image exposing mechanism according to the type of the photosensitive element.

Furthermore, the toner powder developing device 13 may be of any desired type such as the magnetic brush type, cascade type or the powder cloud type. When an electrostatic latent image on the photosensitive element 5 is directly transferred to a transfer paper, it is not necessary to provide the developing device 13 on the peripheral surface of the rotary drum 6.

An optical system indicated generally by reference numeral 16 is provided to project an image of the original *a* supported on the transparent plate 2, onto the photosensitive element 5 in the above-mentioned image-forming zone. This optical system 16 comprises an opening 17 mounted in the upper portion of the housing 1 to expose the original to light, a light source 18 for illuminating the orignal *a* to be copied, a photosensitive element light exposing opening 19 provided in the vicinity of the photosensitive element 5 of the rotary drum in the image-forming zone 8, and a group of reflex mirrors 20, 21 and an in-mirror lens 22 provided to connect optically the original-light-exposing opening 17 with the photosensitive element-light-exposing opening 19 and to form a reverse image of the original *a* to be copied on the photosensitive element 5.

Along the periphery of the rotary drum 6, the transfer zone 9 is provided in succession to the image-forming zone 8. In the housing 1 a passage for copy paper or transfer paper *b* (indicated as a whole by reference numeral 23) is provided so that said passage is circumscribed with the rotary drum 6 in the transfer zone 9. At the upstream end of this transfer paper passage 23, a transfer paper feed mechanism is mounted. For instance, in the embodiment illustrated in FIG. 1, a roll stand 25 supported oscillatably on the machine housing by means of a fulcrum 24 is mounted on the upstream end of the transfer paper passage 23, and a shaft 28 of a reel 27 is dismountably and rotatably mounted on a fitting recess 26 formed on the upper end of this roll stand 25.

Downstream of the reel 27, there are provided both a guide roller 29 and a pair of driven feed rollers 30, 30' provided with a roll paper feeding clutch $C_4$ in order to introduce transfer paper from a transfer paper roll *b'* wound on the shaft of the reel 27. A pair of transfer paper-transporting rollers 31, 31' which are normally driven are disposed between the feed rollers 30, 30' and the transfer zone 9, and a transfer paper-cutting mechanism 32 is mounted between the feed rollers 30, 30' and the transfer paper-transporting rollers 31, 31'.

This transfer paper-cutting mechanism 32 includes a stationary blade member 33 and a rotary blade member 34. The rotary blade member 34 is rotated by excitation of a cutter solenoid $L_1$ and cuts transfer paper *b* passing through the stationary blade member 33 and rotary blade member 34. Accordingly, the position ($P_2$) shown in FIG. 1 and 7 for actuation of the transfer paper-cutting mechanism is the position of the upper edge of the stationary blade member 33. In the non-actuated state, the blade of the rotary blade member 34 is positioned on the upper side of the transfer paper passage between the feed rollers 30, 30' and the transporting rollers 31, 31' so that it does not intersect the transfer paper passage. In this invention, as will be detailed hereinafter, the position of the leading edge of transfer paper at the beginning of feeding and the position for stoppage and standing-by of the leading edge of roll-like transfer paper cut are preferably set at the position ($P_2$) for actuation of the transfer paper-cutting mechanism. In order to attain this feature, upper and lower guide plates 35*a* and 35'*a* are disposed between the cutting mechanism 32 and feed rollers 30, 30', and another upper and lower guide plates 35*b* and 35'*b*, between the cutting mechanism 32 and transporting rollers 31, 31', so that lower guide plates 35'*a* and 35'*b* are positioned in an almost straight line with the upper edge of stationary blade member 33 and the upper guide plates 35*a* and 35*b* are positioned in an almost straight line with the lower edge of the rotary blade member 34 in the non-actuated state. The foregoing structure makes it possible to conduct the transportation and stoppage of transfer paper smoothly without occurrence of paper jamming or other troubles. Further downstream of the normally driven, transporting rollers 31, 31', there are provided upper and lower guide plates 35*c*, 35*c'*, normally driven rollers 36, 36' and upper and lower guide plates 35*d* and 35'*d* to introduce transfer paper *b* into the transfer zone 9.

In the embodiment of the copying apparatus in FIG. 1, a paper feed mechanism for feeding a separate sheet-like transfer paper *b''* is provided independently of the paper feed mechanism for feeding a roll-like transfer paper. More specifically a paper-feeding table 51 is provided openably or dismountably at the end of the machine housing 1 at the upstream end of the transfer paper-transporting passage 23' to feed a separate sheet-like transfer paper *b''*, and at the tip of this paper-feeding table, there are mounted a paper sheet feeding opening 52 and upper and lower guide plates 35*e* and 35'*e* connected to this opening 52. A pair of paper sheet feed driven rollers 53, 53' provided with a sheet paper feed clutch $C_5$ are mounted downstream of the upper and lower guide plates 35*e*, 35'*e*.

Between said sheet paper feed rollers 53, 53' and the above-mentioned transfer paper-transporting rollers 31, 31', upper and lower guide plates 35*f* and 35*f'* are mounted to transport sheet-like transfer paper *b''* to said rollers 31, 31'.

In the copying apparatus illustrated in FIG. 1, the above-mentioned transfer paper-transporting passage 23 is circumscribed with the rotary drum 6 in the transfer zone 9 and forms almost one plane extending from sheet-transporting means 53, 53' to a fixation zone 47. This passage 23 for feeding roll-like transfer paper *b'* joins a passage 23' for feeding separate sheet-like transfer paper *b''* in the position of transporting rollers 31, 31' disposed upstream of the transfer zone 9, and transfer paper is then forwarded through the common transfer paper-transporting passage 23, extending in a straight line. When the passage for transporting a sheet-like transfer paper is thus disposed in a straight line in the machine housing and is circumscribed with the rotary drum 6 in the transfer zone 9, even if a very thin or soft paper, cloth, film or foil is used as the sheet-like transfer paper *b'*, paper jamming can be greatly reduced and the copying operation can be accomplished very assuredly.

Further, if paper jamming is caused in the transfer paper-transporting passage of the copying machine, removal of the jammed paper can be facilitated by disposing openably or dismountably each of members positioned in the transporting passage except for some pairs of transporting rollers. For instance, the roll-like transfer paper-cutting mechanism 32 and guide plates 35*a*, 35'*a*, 35*b*, 35'*b* positioned between the roll-feeding rollers 30, 30' and transporting rollers 31, 31', and guide plates 35*f*, 35*f'* positioned between the transporting rollers 53, 53' and transporting rollers 31, 31' are integrally attached to a supporting frame 54 mounted detachably on the frame of the machine housing 1. Thus, the jamming of paper can easily be inspected by dismounting the foregoing members together with the supporting frame 54. Similarly, guide plates 35*c*, 35'*c* positioned between the transporting rollers 31, 31' and feed rollers 36, 36' are integrally attached to a supporting frame 55 mounted dismountably on the frame of the machine housing 1, so that these plates can be dismounted from the machine housing together with the supporting frame 55. The foregoing structure makes it possible to check jamming of transfer paper in the transfer paper-transporting passage with ease.

In the transfer zone 9, a transfer mechanism 37 is disposed to bring transfer paper *b* into contact with the photosensitive material 5 of the rotary drum 6 and thereby transfer the image onto the transfer paper. This transfer mechanism 37 is constructed of a transfer roller alone or its combination with a corona discharge mechanism. For instance, when the image to be transferred is an electrostatic image, it may be transferred onto transfer paper merely by contacting it with the electrostatic image-carrying rotary drum by means of a roller. Of course, in this case, the transfer of the electrostatic image can be accomplished effectively by forming an electric field between the transfer roller and the substrate of the rotary drum or by effecting the corona discharge from the back face of transfer paper. When the image to be transferred is a toner image, it may be transferred onto transfer paper by contacting it with the toner image-carrying rotary drum by means of the transfer roller or static force and forming an electric field between the transfer roller and the substrate of the rotary drum or effecting the corona discharge from the back face of the transfer paper.

The transfer paper-transporting passage indicated as a whole by reference numeral 23 extends downstream of the transfer zone 9. On the discharge side of the transfer zone of, and adjacent to, the rotary drum 6 there is provided a peeling mechanism 38 to remove transfer paper *b* from the photosensitive material 5 of the rotary drum 6 and direct it toward the said transporting passage. This peeling mechanism 38 is provided with a peeling nail or blade 39 disposed so that its end point is brought into contact with the photosensitive material 5 of the rotary drum 6, and said peeling nail 39 peels off the leading edge of transfer paper *b* from the photosensitive material surface and guides transfer paper *b* to the transfer paper-transporting passage. A fan 41 provided with a projection nozzle 40 directed toward the peeling nail 39 is disposed to assist peeling of the tranfer paper *b* from the photosensitive material surface and introduction of transfer paper *b* into the transfer paper-transporting passage and to accomplish these operations stably and assuredly.

In the position spaced from this peeling mechanism 37 along the rotation direction of the rotary drum 6, there may be provided an exposure source CL for uniform exposure which erases the remaining charge on the photosensitive element 5 and a cleaning mechanism 42 to clean the photosensitive material 5 of the drum 6 by removing the toner from the surface thereof. This cleaning mechanism 42 comprises a roller 43 provided with a rubber or brush surface which is rotated while being contacted with the photosensitive material of the drum 6. In the case of the electrostatic image transfer, of course, provision of this cleaning mechanism may be omitted.

The transfer paper-transporting passage 23 extending to the downstream of the transfer zone 9 is provided with some pair of driven rollers or one or more endless belts and it transports transfer paper through a subsequent treating zone. The treating zone may be a image-fixing zone, in the case of the transfer of toner image transfer and a development and fixing zones in the case of the transfer of static image. In the embodiment shown in FIG. 1, an endless belt 46 supported and driven by a driving pulley 44 and pulleys 45, 45' is mounted to define the lower side of the transfer paper-transporting passage 23, and on the upper side of this transfer paper-transporting passage 23, there is disposed a fixation mechanism 47 to fix the toner image on transfer paper *b*. This fixation mechanism 47 includes an infrared lamp or electric heater 48 and the fixation of the toner image is accomplished by melt-bonding it to transfer paper by this heating member 48. In order to prevent transfer paper from making direct contact with the fixation mechanism, it is possible to mount on the upper side of the transfer paper-transporting passage 23 another guiding belt (not shown) driven and supported by a driving pulley and follow pulleys (not shown). It is also possible to position pulleys 45' and 49 supporting belt 46 near the discharge and in a manner such that the pulleys 45' and 49 contact each other through the belts, whereby transfer paper on which the image has been formed can be discharged assuredly from the fixing zone. Further, on the lower side of the transfer paper-transporting passage 23, there may be provided a suction mechanism 50 to such transfer paper through the endless belt 46, whereby transfer paper is allowed to adhere closely and fixedly to the endless belt 46. In this case, providion of the guiding belt on the upper side may be omitted. Instead of a combination of the infrared lamp or electric heater with transfer paper-transporting belts, a combination of an iron and a pressing roller may be used as the fixation mechanism 46 without disadvantage, as will be described in detail later.

IMAGE-FORMING AREA OF ROTARY DRUM

One of the important features of the present invention is that almost the entire surface of the rotary drum can be utilized as an image-forming area. FIGS. 2–A, 2–B and 2–C show the relation between the rotation of the rotary drum and the photosensitive element 5 which defines the image-forming area on the rotary drum. In FIG. 2–A, the forward end point or leading boundary of the photosensitive element 5, that is, the forward end point S of the image-forming area, coincides with a copying initiation standard position $P_o$ set a little upstream of an upstream end position $P_7$ of the image-forming device. The length of the image-forming area can be chosen so that in this state, the rear end point or trailing boundary of the photosensitive element 5, that is the rear end point F of the image-forming area, is situated in any desired position between the standard position or initial point $P_o$ and the downstream end or terminal point $P_1$ of the transfer device in a counterclockwise direction. Since it is generally desirable to obtain the largest possible copying length as compared with the diameter of the rotary drum, the image-forming area, that is, the photosensitive element 5, should cover almost the entire circumference of the rotary drum 6. In FIG. 2–A, the rotary drum 6 is covered with the photosensitive element 5 over about 290° of its circumerence.

When the copying operation begins, the rotary drum 6 starts from the state shown in FIG. 2–A, and the rotary drum 6 is rotated counterclockwise. The forward end point S of the image-forming area reaches the downstream end position $P_1$ of the transfer device via the image-forming device and the transfer device. The rotary drum 6 continues its rotation while the image formed on the image-forming area 5 is being transferred to the transfer paper *b*. When the forward end point S of the image-forming area coincides the standard point $P_o$ after the completion of the initial one rotation of the rotary drum (see FIG. 2–A), the rear portion of the image-forming area has not yet passed the downstream end position $P_1$ of the transfer device, and the transfer of the image at that portion has not been completed. When the rotary drum 6 further rotates and the rear end point F of the image-forming area 5 coincides the downstream end position $P_1$ of the transfer device, the transfer of the image to the transfer paper is over. The rotary drum 6 still continues to rotate, and stops when the forward end point S of the image-forming area 5 again coincided the standard position $P_o$. Thus, one cycle of the copying operation is finished.

In the embodiment shown in FIGS. 2–A, 2–B and 2–C, the angle between the standard position $P_o$ and the downstream end position $P_1$ of the transfer device in a direction opposite to the rotating direction of the rotary drum is about 135°. It will be evident that even when this angle is larger, one cycle of the copying operation is performed quite similarly. This means that even when the processing zone 7 including the image-forming device and the transfer device stretches over the circumference of the rotary drum 6 at a wider angle, the length of the photosensitive element defining the image-forming area is not restricted.

Thus, in the electrostatic photographic copying apparatus of this invention in which a one-cycle copying operation is performed while the rotary drum 6 rotates through two turns, almost the entire surface of the rotary drum 6 can be utilized as the image-forming area 5, and moreover, the image-forming area is not restricted by the position of the image-forming device or the transfer device. For this reason, the ratio of the maximum copyable length to the diameter of the rotary drum becomes larger, and a drum of a relatively smaller diameter can be utilized.

OUTLINE OF CONTROL MECHANISM

Figure 3:
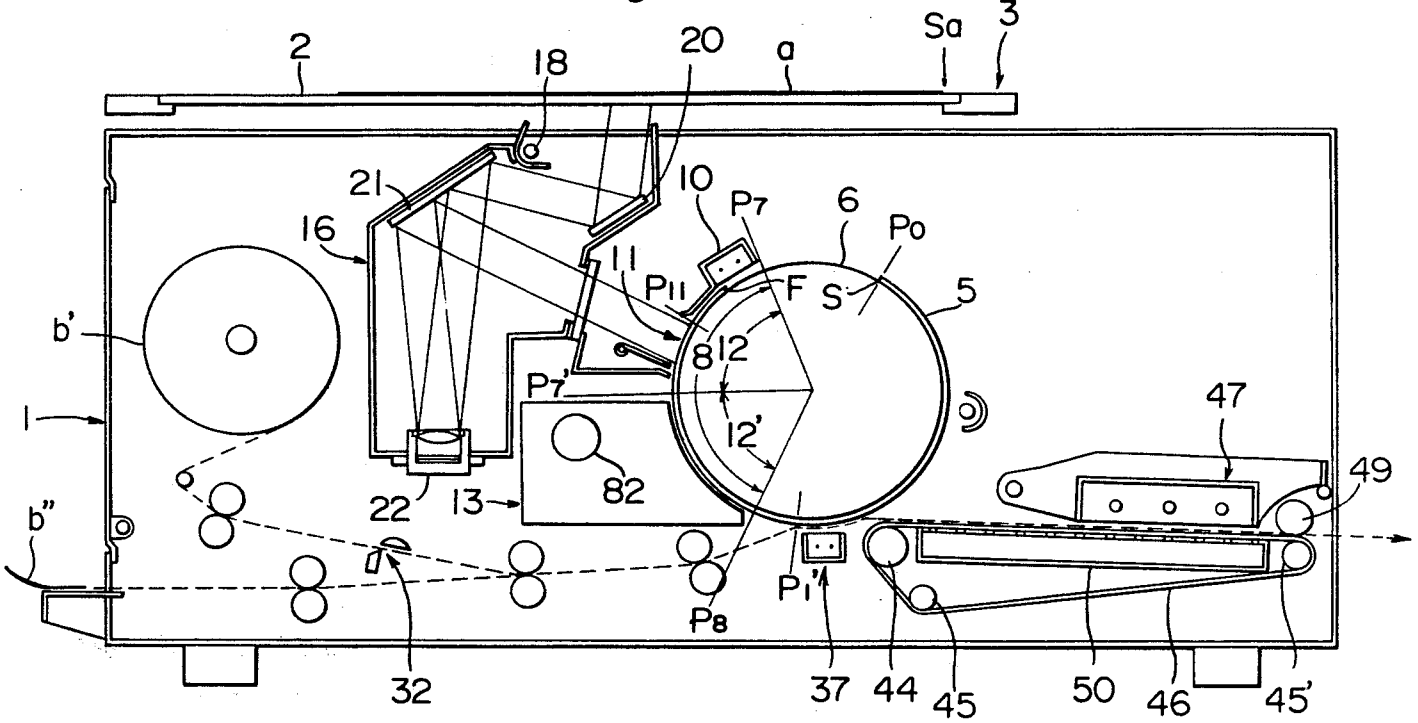

Referring to FIG. 3, the control of each of the devices in the copying apparatus of this invention will be described. The start and stopping of the operation of each of the mechanism in the copying apparatus are controlled by the angular position of the rotary drum 6.

A first control device exercises control so that the cycle of copying operation is started when the forward end point S of the image-forming area 5 coincides with the standard position $P_o$, and the rotary drum 6 is stopped when the forward end point S coincides with the standard position $P_o$ after two turns.

A second control device initiates the operation of devices (charging device 10 and light source 18) utilized for the formation of electrostatic images when the forward end point S has reached the upstream end position $P_7$ of the electrostatic latent image forming area 12 in the first rotating of the rotary drum 6, and stops the operation of these devices when the rear end point F of the image-forming area 5 passes the downstream end position $P_7'$ of the electrostatic image-forming area 12. Furthermore, the second control device initiates the operation of the developer device 13 when the forward end point S has reached the upstream end position $P_7'$ of the developing area 12', and stops its operation when the rear end point F has passed the downstream end $P_8$ of the developing zone 12'. Instead of successively initiating and stopping the operation of the devices in the electrostatic latent image forming zone 12 and the developing device, it is possible to exercise control so that the operations of all the divices utilized in image-formation at a time.

A third control device controls a drive mechanism (to be described) for the moving frame 3 so that when the forward end point S of the image-forming area 5 of the rotary drum 6 has reached the upstream end $P_{11}$ of the exposing opening 11 provided in the image-forming zone 8, slit exposure on an image of the original *a* is projected onto the image-forming area 5.

A fourth control device controls a transfer paper supply device so that when the forward end point S of the image-forming area 5 has reached the upstream end $P_1'$ of the transfer zone 9, the leading edge of the transfer paper *b* synchronously reaches the upstream end $P_1'$ of the transfer zone 9.

CONTROLLING OF SUPPLY AND CUTTING OF TRANSFER PAPER

Supply of a transfer paper is controlled by the fourth control mechanism so that the leading edge of the transfer paper corresponds with that of the image forming area on the rotary drum.

Figure 4:
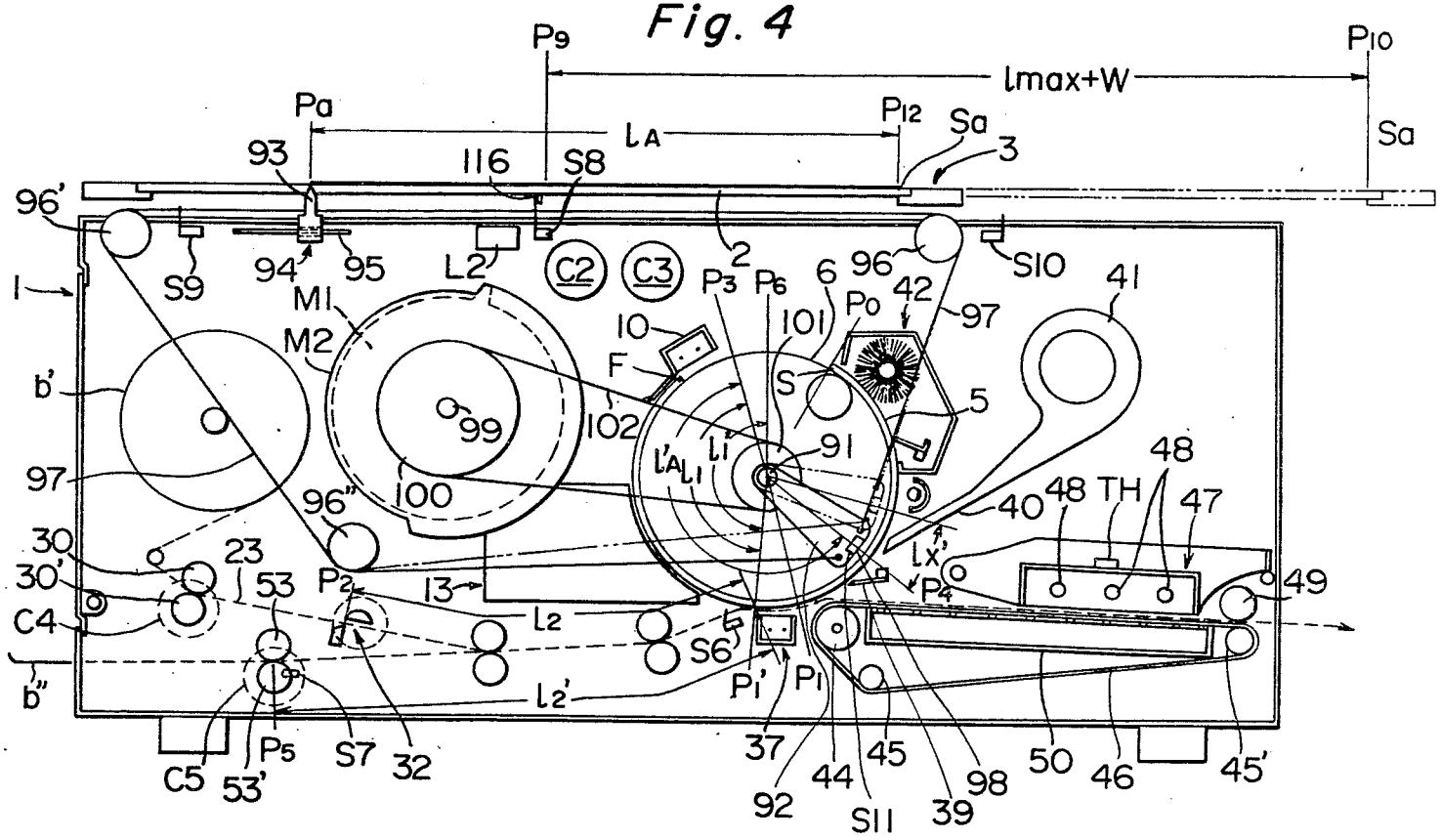

Referring to FIG. 4, the position of cutting a roll of transfer paper *b'* is shown at $P_2$, and the position of contact between the rotary drum 6 and the transfer paper, at $P_1'$. Position $P_3$ for instructing the start of paper supply is set at a separated position along the circumference of the rotary drum 6 in a direction opposite to its rotating direction by the same distance from the contact position $P_1'$ is as the distance $l_2$ between the contact position $P_1'$ and the cutting positon $P_2$. In other words, the position $P_3$ for instructing the supply of paper is determined so that the distance $l_1$ along the circumference of the drum between the paper supply instructing position $P_3$, and the contact position $P_1'$ is equal to the distance $l_2$ along the transfer passage for transfer paper between the cutting position $P_2$ and the contact position $P_1'$.

As will be described in detail later on, the fourth control device is constructed of a cam plate which rotates once while the rotary drum 6 rotates twice and a switch provided around it. When the forward end point S of the image-forming area 5 reaches the paper supply initiating instruction position $P_3$ during the initial rotation of the rotary drum, the fourth control device actuates a clutch $C_4$ for paper feed rollers 30, 30'. However, in the second rotation, the control device does not actuate clutch $C_4$ even if the forward end point S reaches the position $P_3$ (see FIGS. 13-A and 13-B).

In the present invention, the peripheral speed $V_1$ of the rotary drum 6 is always made equal to the travelling speed $V_2$ of transfer paper $b$ ($v_1 = v_2$), and the circumferential distance $l_1$ from the transferring contact position $P_1'$ to the position $P_3$ for instructing initiation of feeding of transfer paper is made equal to the distance $l_2$ of the transfer paper-transporting passage from the transferring contact position $P_1'$ to the position $P_2$ for initiation of feeding of transfer paper. Accordingly when the forward end point S of the image-forming area 5 on the drum 6 reaches the position $P_3$, feeding of a roll-like transfer paper is initiated by actuating the paper feed clutch $C_4$, whereby in the transfer zone 9 the forward end point S of the image-forming area 5 is always engaged synchronously with the leading edge of the transfer paper.

Furthermore, in the present invention, a position $P_4$ for instructing the cutting of roll-like paper is set so that the circumferential distance $l'A$ between the position $P_4$ and the position $P_3$ for instructing the initiation of paper supply is equal to the length $l$A of the original $a$ to be copied. A switch mechanism $S_{11}$ is provided so as to detect the arrival of the forwarding end point S of the image-forming area 5 at the position $P_4$. The switch mechanism $S_{11}$ actuates transfer paper cutting mechanism 32 when the forwarding end point S has arrived at the position $P_4$ during the first rotation of the rotary drum 6. This leads to the cutting of the transferpaper, and the releasing of the clutch $C_4$ thereby to stop the rotation of the paper feed rollers 30, 30'. As a result, the leading edge of the cut transfer paper $b'$ is stopped at the cutting position $P_2$ and maintained there.

As will be described in detail, even when switch $S_{11}$ operates during the second rotation of the rotary drum 6 the device 32 for cutting the transfer paper does not act (see FIGS. 13-A and 13-B).

The switch mechanism $S_{11}$ may be made of a member fixed to the machine frame and a member fixed to the side portion of the rotary drum 6 or in its vicinity so as to define the copying length. It is also possible to provide a plurality of members for defining the cutting positions so that some predetermined copying lengths can be selected stepwise. However, it is preferred to provide a switch mechanism capable of adjusting the cutting instructing position $P_4$ so that random cutting is possible.

A cutting position adjusting mechanism for performing random cutting is shown in FIG. 4. Switch $S_{11}$ for defining the cutting instructing position $P_4$ is positioned on a support plate 92 provided rotatably and coaxially with the shaft 91 of the rotary drum 6. The support plate 92 has a length almost equal to the radius of the drum 6, and in its vicinity, is connected to a wire 97 disposed in a loop shape through guide pulleys 96, 96' and 96''. Furthermore, a setting member 94 having an indicator dial is provided on a guide member 95 so that it can move along the moving frame 3. The setting member is connected to the wire 97 so that the cutting instructing position $P_4$ (switch $S_{11}$) corresponds with the position $P_3$ for instructing the start of paper supply while its indicator dial 93 corresponds with a reference $P_{12}$. Accordingly, the support plate 92 moves according to the movement of the cut length setting member 94, and the distance $l_A$ between the reference position $P_{12}$ and the indicator dial 93 becomes equal to the circumferential distance $l'_A$ between the position $P_3$ and the position $P_4$. Thus, by adjusting the position of the setting member 94 with respect to the original $a$ to be copied, the length of the transfer paper can be made to correspond with a desired length of the original $a$.

Thus, in the copying apparatus of this invention, the position $P_3$ of instructing the start of paper supply is predetermined in relation to the position $P_2$ at which a roll of transfer paper is cut and the forward end of the transfer paper is stopped and made to stay there, and the position $P_4$ is predetermined with regard to the desired copying length. Furthermore, the first switch mechanism $S_{2-2}$ for defining the position $P_3$ and the switch mechanism $S_{11}$ for defining the position $P_4$ are provided. By such a relatively simple construction, the control of the feeding and cutting of a roll of transfer paper is effected with a minimum of detecting and controlling motion, and the jamming of paper can be markedly reduced. In other words, all the control of the feeding and cutting of transfer paper can be made by two actions, one for instructing the feeding of a roll of transfer paper by the forth control mechanism and the other for instructing the cutting of the transfer paper and the stopping of the paper feed by the switch mechanism $S_{11}$.

A mechanism for controlling the supply of the separate sheet-like trnsfer paper $b''$ is shown in FIG. 4. Near the inserting end for the separate sheet-like transfer paper, synchronizing rollers 53 and 53' equipped with clutch $C_5$ are provided. A switch $S_7$ for defining the stopping position $P_5$ for the transfer paper is provided at the nip position of the synchronizing rollers 53 and 53' or immediately downstream thereof. The switch $S_7$ is actuated at the forward end of the sheet-like transfer paper $b''$ inserted, and temporarily stops the rollers 53 and 53' on releasing of the clutch $C_5$. Furthermore, the position $P_6$ of instructing the start of delivering the sheet-like transfer paper is determined along the rotary drum 6 so that the distance $l'_1$ along the circumference of the rotary drum 6 between the position $P_6$ and the contact position $P'_1$ becomes equal to the distance $l'_2$ between the stopping position $P_5$ for the sheet-like transfer paper and the contact position $P_1'$. As will be described in detail with reference to FIG. 5-B, a switch $S_{2-1}$ for defining the position $P_6$ of instructing the start of supplying the sheet-like transfer paper is provided about of a cam plate $M_1$. The switch $S_{s-1}$ causes the engagement of the clutch $C_5$ and therefore, the resumption of the rotation of the rollers 53 and 53' when the forward end point S of image-forming area 5 has reached the position $P_6$ of instructing the start of delivery of the transfer paper. Consequently, the forward end point S of the image-forming area 5 on the rotary drum 6 and the leading edge of the sheet-like transfer paper synchronously reaches the transfer zone 9.

CONTROL DEVICES OPERATING ACCORDING TO THE ROTATION OF ROTARY DRUM

The first to fourth control devices described above control the devices according to the angular position of the rotary drum so that one cycle of the copying operation ends while the rotary drum 6 rotates through two turns. In a preferred embodiment shown in FIGS. 5-A and 5-B, each of these control devices consists of one or a plurality of cam plates which rotate once while the rotary drum 6 rotates through two turns and a plurality of switch means disposed so as to be actuated by the cam plate.

As is shown in FIG. 4, the cam plates M1 and M2 are provided on a common rotating shaft 99 in the machine body 1. The rotary shaft 99 has secured thereto a sprocket or pulley 100. A sprocket or pulley 101 is fixed to a shaft 91 of the rotary drum 6. A chain or wire 102 is hung over between the sprocket 101 and the sprocket 100. The diameter of the sprocket 100 is twice that of the sprocket 101, and when the drum 6 rotates twice, the cam plates M1 and M2 rotate once.

As is shown in detail in FIG. 5-A, the standard position $P_0$ for initiating the copying operation, the position $P_6$ for instructing the initiation of feeding a separated sheet-like sensitive paper, the position $P_3$ for instructing the initiation of feeding a roll-like sensitive paper, the upstream end position $P_7$ of the electrostatic latent image-forming area 12, the upstream end position $P_{11}$ of the exposure opening 11, the upstream end position $P_7'$ of the developing area 12' (or the downstream end position of the electrostatic image forming area 12), the downstream end position $P_8$ of the developing area 12', the upstream end position $P_1'$ of the transfer zone 9 and the downstream end position $P_1$ of the transfer zone 9 are defined around the rotary drum 6.

Around the cam plate M1 are located switch $S_1$ for stopping the rotary drum corresponding to the standard position $P_0$, switch $S_{2-1}$ for initiating the supply of a separated sheet-like transfer paper corresponding to the position $P_6$, switch $S_{2-2}$ for initiating the supply of a roll-like transfer paper corresponding to the position $P_3$ and switch $S_4$ for initiating the slit exposure of the original corresponding to the position $P_{11}$. The switches are disposed so that the angle formed between the switch $S_1$ and switches $S_{2-1}$, $S_{-2-2}$ and $S_4$ respectively with respect to the center of the cam plate M1 is equal to one half of that formed between the position $P_0$ and the positions $P_6$, $P_3$ and $P_{11}$ respectively with respect to the center of the rotary drum 6. The cam plate M1 includes a projection 103 corresponding to the forward end point of the image-forming area on the rotary drum 6. When the forward end point S of the image-forming area on the rotary drum 6 coincides the positions $P_0$, $P_6$, $P_3$ and $P_7'$, the projection 103 of the cam plate M1 pushes the switches $S_1$, $S_{2-1}$, $S_{2-2}$, and $S_4$ and actuates them sequentially.

In FIGS. 5-A and 5-B, the rotary drum 6 rotates when the clutch $C_1$ operates, and stops when the clutch $C_1$ is reset. The clutch $C_1$, as is shown in FIGS. 13-A and 13-B, is connected to an electric source through a normally closed contact $S_{1a}$ of the switch $S_1$ and a normally open contact 1-2 which temporarily comes into contact at the time of pushing the copying initiation switch. When the normally open contact 1-2 of the copying initiation switch is closed by hand, the clutch $C_1$ starts operation, and the rotary drum 6 begins to rotate when the forward end point S of the image-forming area 5 coincides the standard position $P_0$. With the rotation of the rotary drum 6, the cam plate M1 rotates, and its projection 103 departs from the switch $S_1$. As a result, the normally closed contact $S_{1a}$ of the switch $S_1$ is closed. For this reason, even after the normally open contact 1-2 has opened, the clutch $C_1$ continues its operation. When after two turns of the rotary drum 6, the forward end point S of the image-forming area 5 coincides with the standard position $P_0$, the projection 103 of the cam plate M1 urges the switch $S_1$, with the result that the normally closed contact $S_{1a}$ is opened and the actuation of the clutch $C_1$ stops. Thus, the rotary drum 6 is stopped exactly when after its two turns, the forward end point S of the image-forming area coincides with the standard position $P_0$.

When in the first rotation of the rotary drum 6, the forward end point S of the image-forming area 5 reaches the position $P_6$ for instructing the initiation of paper supply, the switch $S_{2-1}$ is actuated by the projection 103 of the cam plate M1. The sheet paper supply clutch $C_5$, as is shown in FIGS. 13-A and 13-B, are connected in series to relay contact 5-1 and normally closed contact $S_{7a}$ of switch $S_7$ which are connected in parallel. A relay R5 which actuates the relay contact 5-1 is connected to an electric source through a normally open contact of the switch $S_7$, a normally open contact of switch $S_{2-1}$ and a normally open contact 3-1. When a sheet-like transfer paper *b''* is inserted, the normally closed contact $S_{7a}$ of the switch $S_7$ is opened, and the normally open contact $S_{7b}$ is closed (see FIG. 4). When the projection 103 of the cam plate M1 is actuated by the switch $S_{2-1}$, the relay $R_5$ is actuated, and the relay contact 5-1 closes to actuate the clutch 5.

When the forward end point S of the image-forming area 5 has reached the position $P_3$ in the first rotation of the rotary drum 6, the switch $S_{2-2}$ is actuated by the projection 103 of the cam plate M1. The roll paper feed clutch $C_4$, as shown in FIGS. 13-A and 13-B, is series-connected through the normally open contact *b* of the switch $S_{2-2}$ and the normally closed contact $S_{11a}$ of the switch $S_{11}$ for instructing the cutting of a roll of paper. The clutch $C_4$ begins to operate when the normally open contact *b* of the switch $S_{2-2}$ is closed, and by the operation of a self-maintaining circuit consisting of a relay R6 and a relay contact 6-1, continues to operate even after the normally open contact $S_{2-2b}$ is opened. The clutch $C_4$ is reset when the normally closed contact *a* of the switch $S_{11}$ opens. When the forward end point S of the image-forming area 5 reaches the upstream end position $P_{11}$ of the exposure opening 11 in the first rotation of the rotary drum 6, the switch $S_4$ is actuated by the projection 103 of the cam plate M1, and by the movement of the moving frame 3, the slit exposure of the original begins. The movement of the moving frame 3 will be described in detail below.

Around the cam plate M2 are provided switch $S_3$ corresponding to the upstream end position $P_7$ in the electrostatic latent image-forming area 12 and switch $S_5$ corresponding to the upstream end position $P_7'$ of the developing zone 12'. In this embodiment, the angle formed by the electrostatic latent image-forming area 12 is substantially equal to that of the developing zone 12'. The cam plate M2 includes an arcuate projection 104 which forms such an angle that when the forward end point S of the image-forming area on the rotary drum 6 reaches the upstream end position $P_7$ of the electrostatic latent image-forming area 12 during its first rotation, it pushes the switch $S_3$, and when the rear end point F of the image-forming area has passed the downstream end $P_7'$ of the electrostatic latent image-forming area 12, it releases the switch $S_3$. Namely, the angle $\theta$ formed by the arcuate projection 104 of the cam plate M2 is expressed by the following equation:

$$\theta = \tfrac{1}{2}(\theta_0 + \theta_1) \qquad 1.$$

wherein $\theta_0$ is the angle formed by the image-forming area of the rotary drum 6, that is the angle formed by the photosensitive element 5, and $\theta_1$ is the angle formed by the electrostatic image-forming area 12.

When in the first rotation of the rotary drum 6, the forward end point S of the image-forming area reaches the upstream end position $P_7'$ of the developing zone 12', the forward end of the arcuate projection 104 of the cam plate M2 pushes the switch $S_5$, and when the rear end point F of the image-forming area reaches the downstream end position $P_8$ of the developing zone 12', the rear end of the arcuate projection 105 of the cam plate M2 departs from the switch $S_5$.

In the embodiment shown in FIG. 5-B, the angle formed by the electrostatic latent image-forming area 12 is equal to the angle formed by the developing zone 12', and therefore, the common cam plate M2 can be utilized for the switches $S_3$ and $S_5$. If these angles are different from each other, one cam may be used for each of the switches $S_3$ and $S_5$, and also it is possible to use a cam plate including a projection 104 forming an angle $\theta$ in the above equation (1) with the larger angle being $\theta_1$. In another modification, the switches $S_3$ and $S_5$ are arranged around CAM 1 so as to actuate them by the projection 103 of CAM 1 and self-maintain them by a suitable means, and the actuation and stopping of each of these switches may be controlled by another suitable means, such as a timer.

It will thus be appreciated that in the embodiment shown in FIGS. 5-A and 5-B, the first control device is composed of the cam plate M1 and the switch means $S_1$; the second control device, of the cam plate M2 and the switch means $S_3$ and $S_5$; the third control device, of the cam plate M1 and the switch means $S_4$; and the fourth control device, of the cam plate M1 and the switch means $S_{2-1}$ and $S_{2-2}$.

CONTROL OF THE MOVEMENT OF THE MOVING FRAME

In the embodiment of the present invention as shown in FIG. 4, the slit exposure of an original is performed as a result of the movement of the moving frame 3 in synchronization with the rotary drum 6.

In FIG. 4, the moving frame 3 is reciprocatingly moved by a frame drive system (see FIGS. 11-A and 11-B) equipped with a clutch $C_3$ for an exposure process (movement in the right direction) and a clutch $C_2$ for a preparatory and return process (movement in the left direction).

When the copying initiation switch PB (FIG. 13-A) is pushed upon the initiation of copying, the clutch $C_2$ operates, and the moving frame 3 begins to move in the left direction from the position at which the standard point $S_a$ of the moving frame 3 coincides with the standard stopping position $P_{12}$, as will be described in detail below. When the standard point $S_a$ on the moving frame 3 has reached the position $P_9$ for initiating the exposure cycle, the switch $S_9$ is actuated by a projection 116 provided on the underside of the moving frame 3, and the clutch $C_2$ is reset. As a result, the moving frame 3 is stopped at this position ready for the next action.

When the forward end point S of the image-forming area reaches the upstream end position $P_{11}$ of the exposing opening 11 (see FIG. 5-A) during the first rotation of the rotary drum 6, the switch $S_4$ is actuated by the projection of the cam plate M1. the switch $S_4$ actuates the clutch $C_3$ and the moving frame 3 begins to move in the right direction for the exposure cycle. When the standard point $S_a$ of the moving frame 3 has reached the position $P_{10}$ at which the exposure cycle ends, the switch $S_{10}$ is actuated by the projection 116 provided on the underside of the moving frame 3, and the switch $S_{10}$ resets the clutch $C_3$ to complete the exposure cycle. At the same time as resetting the clutch $C_3$ the switch $S_{10}$ $_4$actuates the clutch $C_2$ for the the preparatory and return cycle to cause the reversal of the movement of the moving moving frame 3. When the standard point $S_a$ of the moving frame 3 has reached the standard stopping position $P_{12}$, the switch $S_8$ is actuated by the projection 116 provided on the underside of the moving frame 3, and the clutch $C_2$ is reset to stop moving frame 3. The distance of the exposure cycle of the moving frame, that is the distance between the positions $P_9$ and $P_{10}$ is the sum of the maximum length of an original to be copied and the width W of the exposing opening.

In order to stop the moving frame 3 assuredly, it is preferred to provide an restraint mechanism on the underside of the moving frams, as will be shown in detil later (see FIG. 12).

OPTICAL SYSTEM

Figure 6:
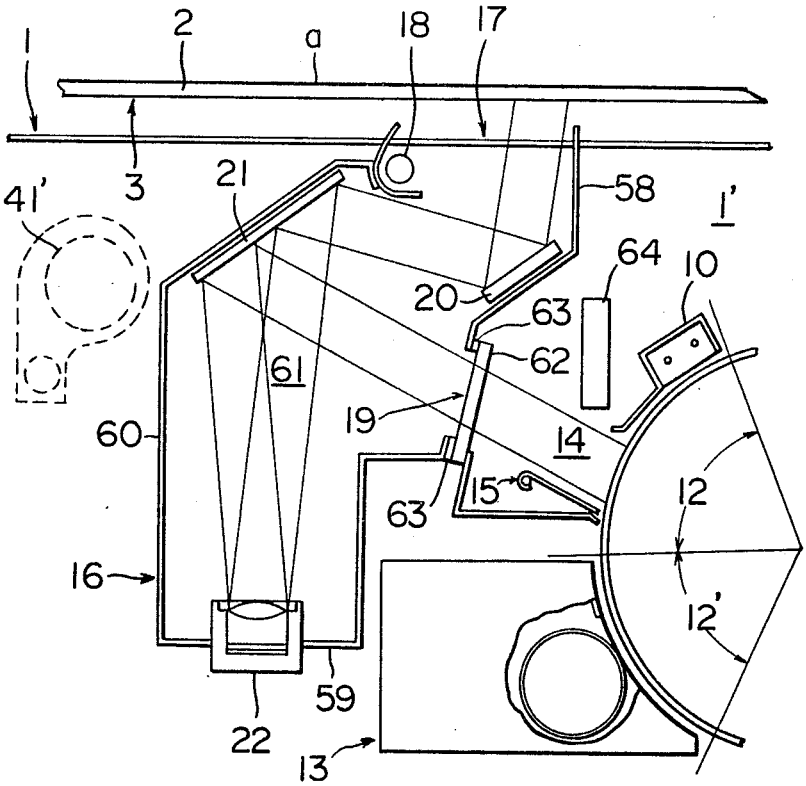
FIG. 6 is a side sectional view which shows on an enlarged scale the optical system and the image-forming zone of the copying apparatus shown in FIG. 1.

As shown in FIG. 6, the optical system of the copying apparatus comprises a light source 18 for light exposure, an opening 17 for exposing the original to light, two reflex mirrors 20, 21, and in-mirror lens 22 and an opening 19 for exposing the photosensitive element 5 to light. These members are disposed on partition walls 58, 59, 60 or disposed so as to constitute at least part of these partition walls. The opening 17 for exposing the original to light is disposed in the upper portion of the machine housing 1. This opening 17 may, or may not, be shielded by a transparent plate. The light source 18 for light exposure is provided on partition wall 60 which is spaced from the partition wall 58 with the opening 17 therebetween, and in the vicinity of the opening 17.

Alternatively, the light source 18 may be provided on both of the partition walls 58 and 60. The opening 19 for exposing the photosensitive element to light is disposed on the partition wall 58 positioned on the side of the rotary drum 6. The first reflex mirror 20 is provided on the partition wall 58; the in-mirror lens 22, on the lower portion of the partition wall 59; and the second reflex mirror 21, on the partition wall 60. The first reflex mirror 20 connects the opening 17 for exposure of the original optically with the second reflex mirror 20. This second reflex mirror 21 is disposed in such a position that it connects the first reflex mirror 20 optically with the in-mirror lens 22 and simultaneously connects the in-mirror lens 22 optically with the opening 19.

In the optical system 16 in this embodiment, the light of the original *a* which is projected from the light source 18 and reflected is reflected by the first reflex mirror 20, and then reflected by the second reflex mirror 21. It then reaches the in-mirror lens 22, and reflected on the surface of the mirror. Then, it is again reflected by the second reflex mirror 21, and via the opening 19, forms an image on the surface of the photosensitive element 5. As is seen from the foregoing explanation, in this optical system, by arranging the first and second reflex mirrors and the in-mirror lens in an optical chamber so that a specific positional relationship as mentioned above can be attained among these optical members, it is possible to utilize the second-reflex mirror in a duplicate manner for reflection and propagation of the light. As a result, a four-fold optical passage for the reverse image can be formed by a minimum unit combination of two reflex mirrors and one in-mirror lens, and since the optical passage is of such four-fold structure, the space for the optical system can be greatly reduced. Further, since the number of members constituting the optical system is very small, the angle determination in these members can be accomplished very easily. Preferably, the in-mirror lens 22 is mounted adjustably on the partition wall 59 to permit easy adjustment of the focal point of the optical system. By this contrivance, the focal point can be adjusted as desired by adjusting the in-mirror lens 22 even when the height of the transparent plate 2 for supporting an original to be copied or the position of the photosensitive element on the surface of the rotary drum is varied.

In the embodiment illustrated in FIG. 6, the optical system 16 forms one chamber 61 substantially isolated from a static image-forming zone 12 and a developing zone 12' which are disposed along the passage for movement of the photosensitive element 5. More specifically, each member of the optical system 16 is disposed inside the partition walls 58, 59, 60 or mounted on such partition wall so that it will act as a part of the partition wall. The opening 19 for light-exposing the photosensitive layer is covered with a transparent plate 62 such as a transparent glass plate and is supported on partition wall 58 through a sealing packing 63. Accordingly, in the area of the opening 19 of the optical system 16, an optical connection is attained to an area to be light-exposed of the photosensitive element 5 but the air current is intercepted from the optical system chamber 61. Alternatively, air may be positively passed into the electrostatic image-forming zone 12 by providing an exhaust port of an exhaust gas duct 64 of a fan 41' on a side wall 1' of the machine housing confronting the electrostatic image-forming zone 12.

In an electrostatic photographic copying apparatus of the type wherein the development is effected using a toner powder, the developing zone is generally disposed just below the zone for forming an electrostatic image by electrification and light exposure. Therefore, operational troubles are brought about by scattering of the toner powder as a result of rotation of the developing drum. When the side wall of the developing chamber is closely contacted with the photosensitive element, the electrostatic image formed on the surface of the photosensitive element is disturbed by friction. In order to prevent occurrence of this undesired phenomenon, a certain clearance should be formed between the side wall of the developing chamber and the surface of the photosensitive element. However, if such a clearance is formed, a fine powder of the toner is scattered through this clearance and adheres to the electrification and light exposure mechanisms of the electrostatic image-forming zone, to contaminate these mechanisms. Especially in the electrification zone, contamination is readily brought about by adsorption of the toner powder by the influence of static electricity generated by corona discharge. Thus, the image is disturbed in the optical system by scattering of the toner powder and a normal discharge of the electrification mechanism is inhibited by the scattered toner powder.

In the embodiment illustrated in FIG. 6, the optical system 16 including lens, mirrors and the like is so constructed as to form one chamber and the area of the opening 19 for exposing the photosensitive material to light is kept in the air-tight state by the transparent plate 62. Therefore, intrusion of the toner powder into the optical system can be effectively prevented. Further, since air is positively blown into the static image-forming zone 12 including the electrification and light exposure mechanisms and the pressure can be maintained in this zone 12 at a level higher than in the developing zone 12', scattering and intrusion of the toner powder into the electrostatic image-forming zone can be prevented effectively. Thus, in the embodiment of the copying apparatus illustrated in FIG. 6, the frequency of cleaning the electrostatic image-forming zone can be greatly reduced and clear copy sheets can be obtained stably even if the copying apparatus is operated for a long period of time.

DEVELOPING DEVICE

Figure 7:
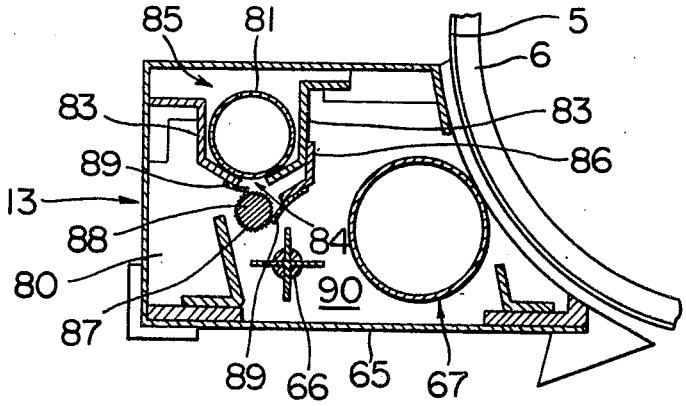
FIG. 7 is a side sectional view shown on an enlarged scale the developing device of the copying apparatus shown in FIG. 1.
Figure 8:
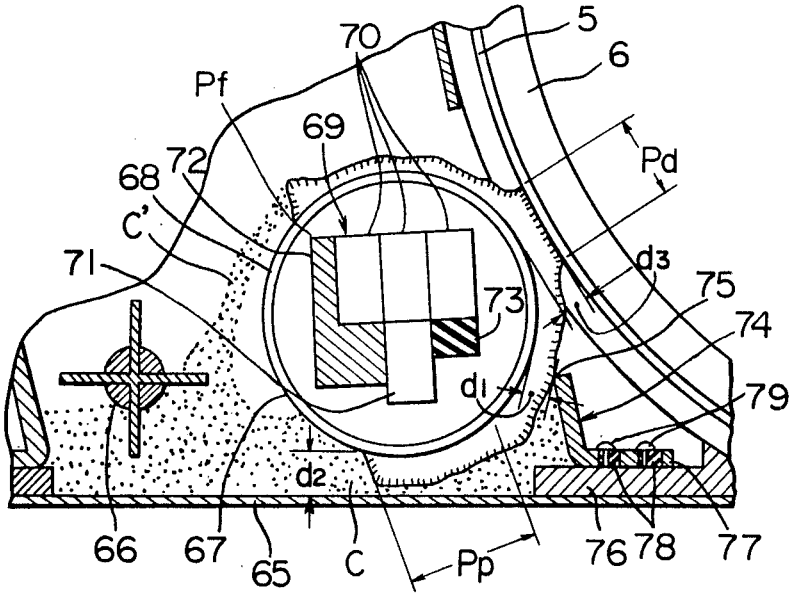
FIG. 8 is a view illustrating the arrangement and function of a magnet means used in the developing device shown in FIG. 7.

The developing device used in the copying apparatus of this invention has such a structure as illustrated in FIGS. 7 and 8. In FIG. 7, the developing device shown generally at 13 includes a developing vessel 65 containing a developer, a stirring member 66 for stirring the developer, and a magnetic brush member 67 provided within the developing vessel 65. The developer may be composed of a toner powder and a magnetic carrier, or of a toner having magnetic properties. Where the developer is composed of the toner powder and a magnetic carrier, the toner powder is rubbed and electrically charged as a result of being stirred by the stirring member 66.

As is illustrated in FIG. 8, this magnetic brush member 67 includes a development sleeve 68 which is hollow and composed of a non-magnetic substance and a magnet means 69 disposed in the stationary state in the development sleeve 68. The magnet means 69 comprises a plurality of magnets 70, 71 and a magnetism-intercepting member 72, which are provided to satisfy the following positional and arrangement requirements. The magnet forms a magnetic field sufficient to attract a developer to the sleeve surface and retaining it there in a zone ranging in the rotating direction of the sleeve from the position $P_p$ of pumping up the developer to the developing position $P_d$, and the magnetism-intercepting member is disposed so that it weakens the magnetic field in at least a part of a zone ranging in the rotating direction of the sleeve from the developing position $P_d$ to the position $P_p$ of pumping up the developer. Preferably the magnetic field formed by the magnet has a flux ($f_1$, for example, about 1000 gauss) suitable for taking up the developer C at the pumping position $P_p$ under the sleeve 68 and a flux ($f_2$, about 700 gauss) substantially erect from the circumferential surface of the sleeve at the developing position $P_d$, and a concentrated flux ($f_3$) along the circumferential surface of the sleeve ranging from the developer-pumping position $P_p$ to the developing position $P_d$.

In conducting the developing operation, the magnet mechanism 69 is arranged fixedly in the state shown in FIG. 4, and when the sleeve 68 is rotated in the counterclockwise direction, the developer *c* is applied to the peripheral face of the sleeve at the developer-pumping position, whereby pumping of the developer is accomplished. The developer *c* is transported to the developing zone $P_d$ while being carried on the circumference of the sleeve. At the developing zone $P_d$, a magnetic brush of high density uniformly earing vertically from the peripheral face of the sleeve is formed, and a close contact of this magnetic brush with the electrostatic image-carrying photosensitive element 5 can be ensured. Thus, the electrostatic image on the photosensitive element is developed with the charge toner retained by the magnetic carrier. The developer which has completed the developing operation is rotated in the counterclockwise direction from the developing position $P_d$ while being carried on the circumference of the sleeve and is transported to the carrier-peeling position P*f* located on the opposite side of the developing position P*d*. At this carrier-peeling position P*f*, the magnetic flux density on the peripheral face of the sleeve is drastically lowered and the developer *c'* transported while being retained on the circumferential face of the sleeve is peeled off therefrom by the gravity and centrifugal force and is allowed to fall down on the bottom of a developer vessel 65. At the point of falling of the developer *c'*, there is provided a stirring mechanism 66 which rotates in the direction opposite to the direction of rotation of the sleeve, namely in the clockwise direction. This stirring mechanism 66 is mounted to stir the developer *c'* having a lowered concentration of the toner powder with a freshly supplied toner powder and to feed a fresh supply of the developer to the developer-pumping position after adjustment of the toner concentration. In the development apparatus of this embodiment having the foregoing structure, it is possible to form a clear toner image stably even after the operation has been continued for a long time.

The surface of the developing sleeve 68 may be smooth or in order to retain the developer thereon assuredly and easily, the surface has a roulette, for instance, a roulette of a parallel pattern.

Further, the magnetism-shielding member 72 or a combination of the magnetism-shielding member 72 with a member 73 composed of non-magnetic substance (for example, aluminum) may be provided as the magnet-supporting member on the side wall of the developer vessel so that the angle of the magnet mechanism can be adjusted.

In the developing apparatus shown in FIGS. 7 and 8, a brush length-adjusting mechanism 74 is disposed in the vicinity of the magnetic brush-supporting surface of the magnetic brush mechanism 67, i.e., the surface of the developing sleeve 68, between the developer-pumping position $P_p$ of the magnetic brush mechanism and the developing position Pd where the magnetic brush is brought into contact with the electrostatic image-carrying surface 5. This brush length-adjusting mechanism 74 comprises a sharp tip point 75 and a slide member 77 mounted movably along the bottom face of the developer vessel 65 or a supporting seat 76 provided on the bottom face of the vessel 65.

This slide member 77 comprises, for instance, long holes 78 perforated in the direction rectangular to the axis of the magnetic brush mechanism 67, and screws 79 are fitted to the supporting seat 76 through said long holes 78, whereby the brush length-adjusting mechanism 74 can be fixed at an optional position. In addition to these adjustment members, any of known mechanisms can be optionally used to adjust the position of the tip point 75 of the brush length-adjusting mechanism.

The adjustment of the position of this brush length-adjusting mechanism 74 is performed in the following manner by the above-mentioned adjustment mechanism.

a. The distance $d_1$ between the tip point 75 of the brush length-adjusting mechanism 74 and the magnetic brush-supporting surface (the surface of the sleeve 68) is made shorter than the distance $d_2$ between the magnetic brush-supporting surface and the bottom face of the developer vessel at the developer-pumping position $P_p$.

b. the distance $d_3$ between the electrostatic image-carrying surface 5 and the magnetic brush-supporting surface at the developing position $P_d$ is made a little shorter than the distance $d_1$ between the tip point 75 of the brush length-adjusting mechanism and the magnetic brush-supporting surface.

The distance $d_3$ between the electrostatice image-carrying surface 5 and the magnetic brush-supporting surface is varied considerably depending on the kind of the electrostatic image-carrying element. For instance, a good image is obtained when in the case of a zinc oxide photosensitive element the distance *d* is about 4 mm and in the case of a cadmium sulfide photosensitive element the distance $d_3$ is about 2 mm. The distance $d_3$ can be easily adjusted as desired, for example, by providing the entire developing device or the magnetic brush member movably with respect to the sensitive drum. The distance $d_2$ between the magnetic brush-supporting surface and the bottom face of the developer vessel is made rather longer than the distance $d_3$ so that at the developer-pumping position $P_p$ the pumping of the developer can be accomplished sufficiently and a fresh developer can be sufficiently supplied at said pumping position $P_p$. The distance $d_1$ between the tip point 75 of the brush length-adjusting mechanism and the magnetic brush-supporting surface is made a little longer than the distance $d_3$. More specifically, the distance $d_1$ is so set that the value of $(d_1 - d_3)$ is generally 0 to 2 mm, especially about 0.5 mm.

When the distance $d_1$ between the tip point 75 of the brush length-adjusting mechanism and the magnetic brush-supporting surface is adjusted in the foregoing manner, the developer *c* pumped at the developer-pumping position $P_p$ and transported therefrom is brought into a slidable contact with the tip point 75 of the brush length-adjusting mechanism and the excessive portion of the developer is removed. Accordingly, a magnetic toner giving a magnetic brush of uniform density and uniform length earing at the developing zone P*d* and an appropriate amount of a developing toner (the amount of the developing toner being not so excessive as will cause excessive application of the toner on the electrostatic image-supporting face and being not so scarce as will cause insufficient application of the toner on the electrostatic image-supporting surface) are transported always stably to the developing zone P*d*. Furthermore, by adjusting the above distance $d_1$ within a specific range in relation to the clearance $d_3$ at the developing zone P*d*, a light, sure and uniform contact can be attained between the magnetic brush and the electrostatic image-carrying face at the developing position P*d*, whereby the electrostatic image can be developed faithfully.

In the magnetic brush mechanism 67, it is preferred that a substantially vertical magnetic brush is formed at the above-mentioned developing zone P*d*. In this case, the toner powder can be tightly and uniformly contacted with the electrostatic image-carrying surface 5 according to the magnetic brush. In order to attain this feature, a developing counter pole (not shown) may be disposed in the substantially stationary state in the vicinity of the inner face of the portion of the rotary drum 6 confronting the magnetic brush mechanism 67.

The supply of the developing toner will now be described by referring to FIG. 3 again.

In the upper portion of the developer vessel 65 forming one room an inlet 82 (see FIG. 3) is provided on the side wall 80 of the developer vessel to insert a cylindrical cartridge 81 for supply of a toner, and a supporting member 83 is provided on a toner supply chamber 85 to support rotatably the cartridge 81 inserted from the inlet 82. This toner supply chamber 85 is separated through partition walls 86 and an opening 84 is provided on the lower partition wall.

The toner supply cartridge 81 comprises, for instance, a cylinder, both side ends of which are closed and which is provided with an opening sealable and openable along the substantially entire length of the cylinder. A toner powder is contained in the cylinder.

In supplying a toner into the toner supply chamber 85, the opening of the cartridge 89 faces upwardly, and in this state the opening is unsealed. Then, while maintaining the cartridge in this state, it is inserted into the interior of the toner supply chamber 85 through the inlet 82 provided on the side wall 80 of the developer vessel, and then the cartridge 81 is turned by an angle of 180°, whereby the opening of the cartridge faces downwardly and a necessary amount of the toner is supplied into the toner supply chamber 85.

In the embodiment shown in FIG. 3, at the position of the opening 84 provided in the lower portion of the toner supply chamber 85, there is rotatably mounted a toner supply roller 88 having grooves 87 on the surface thereof. On the lower end portion of the partition walls 83 and 86, there are fixed one ends of elastic members 89 composed of a flexible material such as a Mylar film, in a manner such that the other ends of the elastic members 103 make contact with the peripheral surface of the toner supply roller 88. When the toner supply roller 88 is stopped, the toner supply chamber 85 and a developing room 90 are in the enclosed state. When the toner supply roller 88 is rotated in the clockwise direction, the toner contained in spaces of the grooves on the surface thereof is fed into the developing room 90. The above-mentioned agitation mechanism 66 is disposed below the toner supply roller 88, and it frictionally charges the freshly supplied toner while mixing it with the magnetic carrier, and the resulting developer composition is fed to the developer-pumping position of the magnetic brush mechanism 67 by means of this agitation mechanism 69.

In the foregoing manner, in the toner supply mechanism illustrated in FIG. 3, an appropriate amount of toner powder is freshly supplied by rotating manually or automatically the toner supply roller 88 after obtaining a prescribed number of copies, and the advantage that this toner-supplying operation can be accomplished without taking out the development mechanism 13 from the machine housing can be attained in this embodiment.

OTHER EMBODIMENTS OF THE FIXATION DEVICE

Figure 9:
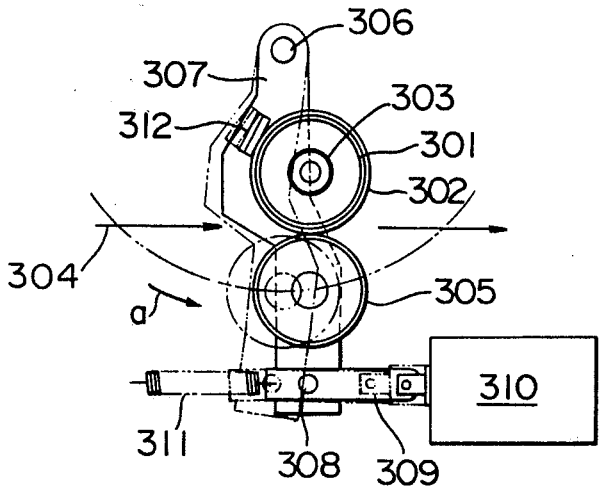
FIG. 9 is a view showing another embodiment of the fixing device.

In place of the fixation device composed of a combination of the endless belt 46 and heating means 48 as shown in FIG. 1, a combination of a heating roller 301 and a press roller 305 as shown in FIG. 9 can be utilized.

Referring to FIG. 9, the heating roller 301 is rotatably fitted to bearings (not shown) which are fixed to the machine frame. The circumferential surface of the heating roller 301 is covered with a material 302 having superior strippability, heat resistance and abrasion resistance and capable of being deformed elastically (for example, IT 68S, a tradename for the product of Mochida Shoko Company). The heating roller 301 further include inside a heater 303 fixed to the machine frame independently from the heating roller 301 so as not to make contact with the inside surface of the heating roller 301. A press roller 305 made of a metal of good heat conductivity is provided under the heating roller 301. The roller 305 is rotatably fitted to a sub-frame 307 which is provided on the machine frame oscillatably about a shaft 306. The sub-frame 307 is connected to a plate 309 at its lower end by means of a pin 308. The plate 309 is connected at its one end to a solenoid 310 and at the other to a spring 311.

When transfer paper is not delivered (when the fixation device is in a non-operating condition), the solenoid 310 is demagnetized, and the sub-frame 307 is located on the position shown by a dotted line, by the action of the spring 311. At this position, the press roller 305 and cleaner device 312 are spaced from the heating roller 301 by a short distance. When the transfer paper is delivered along a passageway 304 and reaches a certain position slightly upstream of the heating roller 301, the solenoid 310 is magnetized by a suitable detecting means (not shown), and the sub-frame 307 is rotated about the shaft 306 in the direction of arrow *a* to the position shown by a solid line. As a result, the press roller 305 and the cleaner means 312 provided on the sub-frame 307 make contact with the heating roller 301.

While the transfer paper passes between the heating roller 301 and the press roller 305, the toner image on the transfer paper is heated by the heating roller 301 and melted and fixed to the transfer paper. When the rear edge of the transfer paper has passed between the heating roller 301 and the press roller 305, the solenoid 310 is demagnetized by a suitable detecting means (not shown), and the sub-frame 307 again returns to the position shown by the dotten line.

In this way, by separating the press roller 305 from the heating roller 301 while the fixation is not performed, the undesirable deformation of the heating roller 301 can be prevented.

MOUNTING AND DEMOUNTING DEVICE FOR PHOTOSENSITIVE ELEMENT

In the copying apparatus in accordance with this invention, the photosensitive element 5 on the rotary drum 6 can also be formed by depositing a photosensitive material directly onto the drum by vacuum evaporation. However, in a preferred embodiment of this invention, the photosensitive element 5 is fitted removably onto the rotary drum 6.

Figure 10:
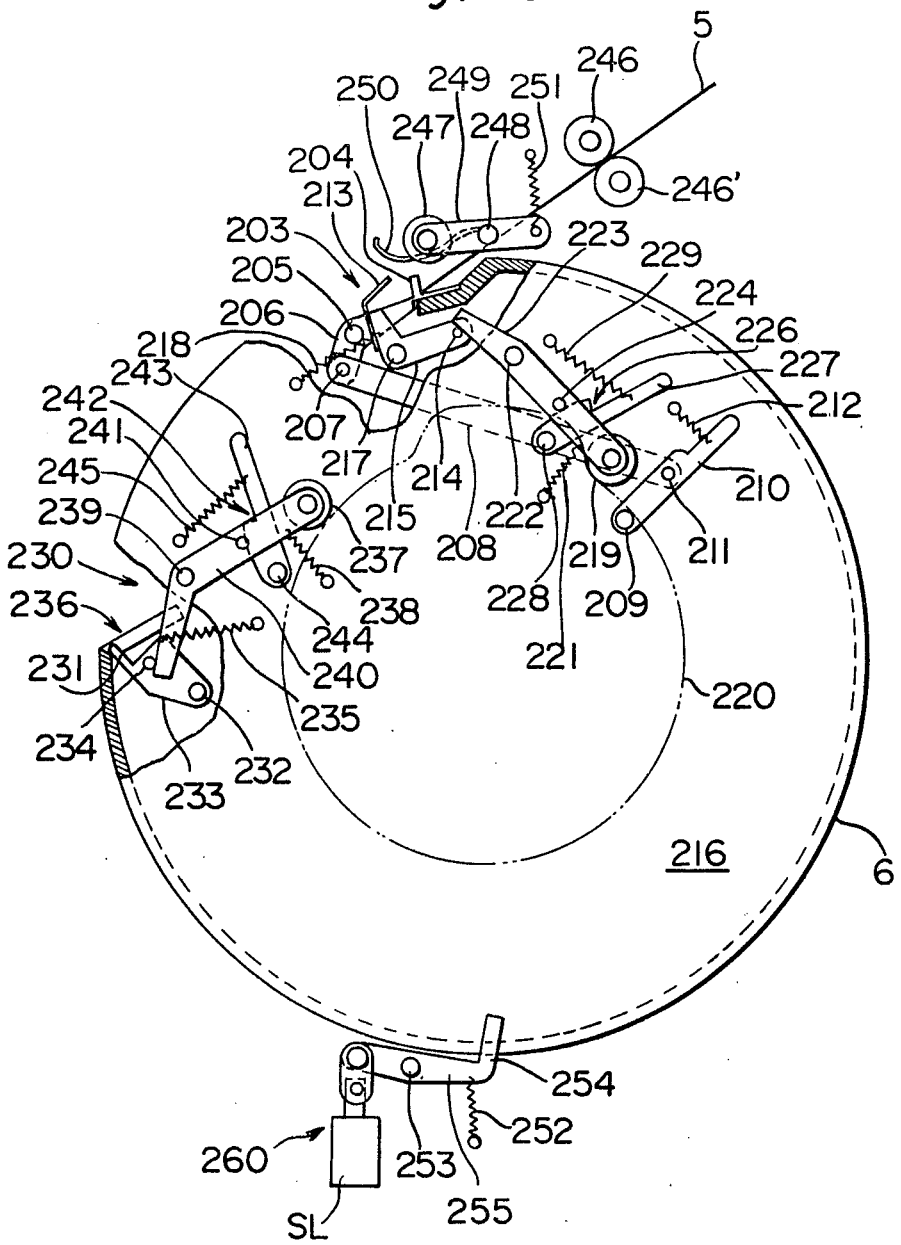
FIG. 10 is a view showing a means for mounting and removing a photosenstive element on and from the rotary drum.

Referring to FIG. 10, a preferred mounting and dismounting mechanism for fitting the sheet-like photosensitive element 5 automatically to the rotary drum 6 and removing it from the drum will be described.

In FIG. 10, a recess 203 is provided on the peripheral surface of the rotary drum 6, and in the recess 203 is provided a photosensitive element discharge lever 206 which is oscillatably provided on a support shaft 205 and having at its one end an abutting element 204 for positioning the photosensitive element 5 by abutment with the leasing edge of the element 5. The other end of the discharge lever 206 is pivotally mounted by means of a pin 207 to one end of an intermediate lever 208. The other end of the intermediate lever 208 is pivotally mounted by a discharge actuating lever 210 provided oscillatably on a support shaft 209 and a pin 211. The force in the counterclockwise direction is always exerted by a spring 212 on the discharge actuating lever 210 so that the force always causes the abutting element 204 of the discharge lever 206 to be urged against the peripheral surface of the rotary drum in the recess 203 through the intermediate lever 208.

A lever 215 having a press plate 213 for pressing the leading edge of the photosensitive element 5 at one end and a pin 214 on the other is oscillatably fixed to a support shaft 217 which is fixed to a side plate 216 of the rotary drum 6. The force in the counterclockwise direction is always exerted by a spring 218 on the lever 215. Furthermore, an actuating lever 223 is pivotally mounted on a shaft 222 so as to make contact with the lever 215 at its one end. A rotor 219 which is urged against the peripheral surface of a fixed cam 220 by means of a spring 221 is rotatably fitted to the other end of the actuating lever 223. The actuating lever 223 further includes an inwardly projecting pin 224 fixed between the support shaft 222 and the rotor 219. The fixed cam 220 is secured to the machine frame (not shown), and its peripheral surface forms an arcuate surface concentric with the rotary drum 6 with raised portions existing partly.

When the rotary drum 6 rotates counterclockwise and the rotor 219 rises from the lower portion of the fixed cam 220 to the raised portion thereof, the actuating lever 223 oscillates counterclockwise in resistance to the force of the spring 221. As a result, the lever 215 is oscillated clockwise in resistance to the force of the spring 218, and the press plate 213 at the end of the lever 215 holds the leading edge of the photosensitive element 5 on one end of the discharge lever 206.

In order to maintain the actuating lever 223 in this condition, a locking lever 227 is oscillatably fitted to a shaft 228. The locking lever 227 includes an engaging surface 226 at its center, and is under such a force as to cause its rotation in the counterclockwise direction by the spring 229. When the rotor 219 rises along the cam 220, the locking lever 227 rotates slightly in the counterclockwise direction, and the pin 224 of the actuating lever 223 comes into engagement with the engaging surface 226 of the locking lever 227, thereby to prevent the press plate 213 of the lever 215 from rotating counterclockwise by the force of the spring 218.

In order to holds the rear end of photosensitive element 5, a recess 230 is provided on the peripheral surface of the rotary drum 6, and in a hole 236 of the recess 230 is provided a lever 233 whose end portion is pivotally mounted to a shaft 232 provided rotatably on the machine frame. The lever 233 includes pulling nails 231 the number of which corresponds to that of a plurality of holes provided at the rear end of the photosensitive element 5, and also a pin 234 projecting from its side surface. The lever 233 is under a counterclockwise force by means of a spring 235. An actuating lever 240 one end of which is in abutment with the pin 234 of the lever 233 is oscillatably mounted on a shaft 239. The actuating lever 240 has at its one end a rotor 237 rotatably mounted thereon and a pin 241 projecting sideways between the rotor 237 and the shaft 239. The rotor 237 is urged against the circumferential surface of the fixed cam.

Thus, when the rotary drum 6 rotates counterclockwise and the hole provided at the rear end of the photosensitive element 5 coincides with the hole 236 of the recess 230, the rotor 237 rises from the lower portion to the raised portion of the fixed cam 220, and the actuating lever 240 oscillates counterclockwise in resistance to the force of the spring 238 to oscillate the pulling lever 233 in the clockwise direction by the force of the spring 235. As a result, the pulling nail 231 at one end of the lever 233 is inserted in the hole of the photosensitive element 5 to pull the rear end of the photosensitive element 5 towards the center of the drum 6 and bring the photosensitive element 5 into intimate contact with the peripheral surface of the rotary drum 6. In order to maintain the actuating lever 240 in this condition, a locking lever 243 is oscillatably mounted on a shaft 244. The locking lever 243 includes an engaging surface 42 at its center, and the force is exerted by means of a spring 245 so as to rotate the lever 243 counterclockwise. When the rotor 237 rises, the locking lever 243 slightly rotates counterclockeise, and the pin 241 of the actuating lever 240 comes into engagement with the engaging surface 242 of the locking lever 243, thereby to prevent the lever 233 from rotating in the clockwise direction by the spring 245.

Near the rotary drum 6 are provided rollers 246 and 246' for transferring the photosensitive element. These rollers transfer the photosensitive element 5 so that its leading edge comes into contact with the abutting element 204 in synchronization with the rotation of the rotary drum. In order to bring the photosensitive element 5, the leading edge of which is held by the abutting element 204 and the press plate 213, into intimate and exact contact with the peripheral surface of the rotary drum 6, a press roller 247 is provided in proximity to the peripheral surface of the rotary drum 6. The press roller 247 is rotatably provided on one end of a lever 249 which is oscillatably mounted on a shaft 248. The press roller 247 is under such a force as to urge it against the peripheral surface of the rotary drum 6 by a spring 251 fitted to the other end of the lever 249. Preferably, the lever 249 has a press element 250 which extends beyond a press roller 247. In order to prolong the life of the photosensitive element 5, it is preferred that a mechanical or electrical means (not shown) for rotating the lever 249 clockwise so that upon the completion of the mounting of the photosensitive element 5, the roller 247 is detached from the peripheral surface of the rotary drum 6.

In order to remove the photosensitive element 5 from the rotary drum 6, a mechanism 260 for releasing locking is provided near the peripheral surface of the rotary drum. The lock releasing mechanism 260 consists of a lever 255 mounted oscillatably on a shaft 253 and a solenoid SL connected to one end of the lever 255. The other end portion 254 of the lever 255 is normally at a position spaced from a moving path of the discharge actuating lever 210 and the locking levers 227 and 243 by the force of spring 252. When it is desired to remove the photosensitive element 5, the solenoid SL is magnetized to rotate the lever 255 counterclockwise, and the lever 254 comes into the moving path of the levers 210, 227 and 243. As a result, the end portion 254 of the lever first abuts the locking lever 227 with the rotation of the photosensitive drum 6 to release the engagement between the engaging surface 226 of the lever 227 and the pin 224 of the actuating lever 223 and to separate the press plate 213 from the photosensitive element 5. Subsequently, the lever end portion 254 abuts the discharge actuating lever 210 to rotate the discharge actuating lever 210 clockwise in resistance to the force of the spring 212 and rotate the abutting element 204 counterclockwise about the shaft 205, thereby directing the leading edge of the photosensitive element 5 towards a photosensitive element discharge mechanism (not shown). Furthermore, when the rotary drum 6 rotates and the lever end portion 254 abuts the locking lever 243, the engagement between the engaging surface 242 of the lever 243 and the pin 241 of the actuating lever 240 is released, and the actuating lever 240 is rotated clockwise by the force of the spring 238. The lever 233 is rotated counterclockwise by the end portion of the actuating lever 240. Consequently, the engagement between the pulling nail 231 and the hole at the rear end of the photosensitive element 5 is released.

OTHER CONTROL DEVICES

As shown in FIG. 4, it is desirable that in proximity to the upstream of the upstream end $P_1'$ of the transfer zone 9, a switch $S_6$ for controlling the application of an electric potential between the rotary drum 6 and the transfer device 37. The switch $S_6$ controls the transfer device 37 so that when the leading edge of transfer paper reaches the upstream end $P_1'$ of the transfer zone 9, the application of potential begins, and it is stopped when the rear end of the transfer paper has passed the downstream end $P_1$ of the transfer zone.

A thermostat TH is provided on the upper part of the fixation means 47, as shown in FIG. 4. The thermostat TH includes a normally closed contact for controlling the current supply to heating element 48 so as to maintain the heating element 48 at a predetermined temperature, and a normally open contact for prohibiting the copying operation until the heating element attains the predetermined temperature.

DRIVE SYSTEM

The operation of each mechanism of the copying apparatus of this invention is accomplished by the drive system illustrated in FIGS. 11-A and 11-B.

In FIG. 11-A, various beltz and pairs of transporting rollers provided in the transfer paper-transporting passage (FIG. 1), except a pair of roll-like transfer paper feed rollers and a pair of sheet-like transfer paper feed rollers, are continuously driven through a chain 105 by means of a driving motor DM. A pair of the roll-like paper feed rollers 30, 30' or a pair of the sheet-like paper feed rollers 53, 53' are driven through the chain 105 only when the roll-like paper feed clutch $C_4$ or sheet-like paper feed clutch $C_5$ is actuated. The rotary drum 6 is driven through a driving chain 109 only when the drum-moving clutch $C_1$ is actuated.

The reciprocating movement of the moving frame 3 is accomplished by a moving frame-drive mechanism comprising a clutch $C_3$ for the moving exposure cycle (movement in the right direction) and clutch $C_2$ for the return cycle (movement in the left direction). Such a drive mechanism may, for example, be a combination of a drive driven and rotated in one or reverse direction by change-over of the clutches $C_3$ and $C_2$ and a wire, and a plurality of drive rotors driven and rotated in one or reverse direction by change-over of the clutches $C_2$ anc $C_3$.

A embodiment of a drive mechanism for the moving frame is shown in FIGS. 11-A and 11-B.

More specifically, wire 107 is wound on drive drum 106 and one end of the wire 107 is fixed on a wire-fixing point 107' of the moving frame 3 through a reel 108 pivoted on one end of the machine housing 1, while the other end of the wire 119 is fixed to the wire-fixing point 121 of the moving frame 3 through a reel 108' pivoted on the other end of the machine housing 1. As is illustrated in FIG. 11-B, electromagnetic clutches $C_2$ and $C_3$ including sprockets 110 and 110', respectively, which are continuously driven by the driving chain 105, are attached to the machine housing 1. The rotary disc $C_2'$ of the electromagnetic clutch $C_2$, the driving drum 106 and a sprocket 111 are mounted on shaft 112, and the rotary disc $C_3'$ of the electromagnetic clutch $C_3$ and a sprocket 113 are mounted on shaft 112'. A chain 114 is hung on the sprockets 111 and 113 so that both the shafts 112 and 112' are rotated in the same direction. The sprockets 110 and 110' are rotated at the same speed but in directions reverse to each other. When by the operation of the change-over mechanism the magnetic clutch mechanism $C_2$ is energized, the rotary disc $C_2'$ is connected with a clutch plate $110_a'$ of the sprocket 110 by a magnetic force and hence, the driving drum 106 is rotated in the same direction as the sprocket 110 and the moving frame 3 is moved on the exposure process by the wire 107. At this time, the shaft 112' is also rotated through sprockets 111 and 113 and the chain 114, but since the electromagnetic clutch mechanism $C_3$ is not energized, the sprocket 110' is kept with respect to the shaft 112'. Then, by the return of the change-over mechanism, the electromagnetic clutch mechanism $C_3$ is energized and the electromagnetic clutch mechanism $C_2$ are not energized. In this case, the sprocket 110' and shaft 112' are connected to each other by a magnetic force, and the drive drum 106 is rotated in the direction opposite to the rotating direction in the above-mentioned case through the shaft 112, sprocket 111, chain 114, sprocket 113 and shaft 112' whereby the moving frame 3 is moved on the return cycle by the wire 107. Also in this case the sprocket 110 is kept idle with respect to the shaft 112.

The direction of the reciprocating movement of the moving frame 3 is switched in the above-mentioned manner.

RESTRAINT MECHANISM

A restraint mechanism such as illustrated in FIG. 12 is provided to restrain the moving frame 3 at the standard stop position without over-running when it has completed the travel of the return cycle and to prevent the once restrained moving frame from moving freely even when the electric source of the copying machine is turned off. This restraint mechanism comprises a projecting lever 116, which projects through the lower edge 115 of the moving frame 3 and a locking piece 118 having a notch 117 engageable with the projecting lever 116. The locking piece 118 is mounted oscillatably around a fulcrum 119 on the side wall of the machine housing 1 and forced toward the projecting lever 116 with a spring 120.

A switch $S_8$ for stopping the motion of the moving frame 3 by releasing both the clutches $C_2$ and $C_3$ is provided in combination with the restraining mechanism. This switch $S_8$ is provided at such a position that it is urged by the forward end 121 of the projecting lever 116 when the projecting lever 116 is in engagement with the notch 117 of the locking piece 118. One end 123 of the locking piece 118 is connected to the start solenoid $L_2$ through a link 124. As will be described in detail below, when the copying start switch PB (see FIG. 13) is pushed, the start solenoid $L_2$ is energized to release the engagement between the projecting lever 116 and the notch 117. Then, before the moving frame 3 is returned, the supply of electricity flow to the start solenoid $L_2$ is stopped. As a result, the moving lever 3 that has returned is effectively locked by the locking piece 118, and simultaneously, its movement is stopped by the switch $S_8$.

Furthermore, such an arrangement is made that the start of the movement of the moving frame 3 in the exposure cycle (movement in the reverse direction) is retarded from the initiation of actuating the start solenoid $L_2$ by the time required for releasing the engagement between the projecting lever 116 of the moving frame 3 and the notch 117 of the locking piece 118.

OPERATION

The operations of the above-described mechanisms of the electrostatic photographic copying apparatus of this invention are accomplished in the following manner by the electric circuit shown in FIGS. 13-A and 13-B and the control system illustrated in FIG. 4.

I. In the case of automatic feeding of a roll of transfer paper

1. When the main switch MS is closed, the drive motor DM, exhaust motor BM, separate motor SM nd the heater 48 of the fixation mechanism 47 are energized.

2. When the temperature of the heater 48 of the fixation mechanism 47 is elevated to a predetermined level, the normally open contact TH2 of the thermostat TH is closed to light a feed lamp FL, by which the operator can know that the apparatus is in the operable state.

3. The length $l_A$ required for copying the original *a* is set by moving the transfer paper cutting length-determining mechanism 94, whereby the switch $S_{11}$ for instructing cutting of transfer paper, is set at the desired position.

4. The copying initiation switch PB is pushed to close its normally open contact. By this, relay R2 is actuated via the normally open contact of the switch PB and the normally closed contact of the switch $S_{10}$ for detecting the dnd of the moving frame moving to the right. Furthermore, the normally open contact 2-3 of the relay R2 is closed to enable the relay R2 to be self-maintained.

4-1. Relay R1 actuates by the closing of the normally open contact 2-1, and by this, the following operation is performed.

4-1-1. The normally open contact 1-2 is closed, and the clutch $C_1$ is actuated. This causes the rotation of the rotary drum 6 (driving of the rotary drum 6). With the driving of the rotary drum 6, the normally closed contact *a* of the switch $S_1$ is closed, and the normally open contact *b* is opened.

Furthermore, the lighting of the cleaning light source CL of the cleaning mechanism 42, and the driving of the drive motor CM for the cleaning roller 43 are started (start of the cleaning cycle).

4-1-2. The relay R3 is actuated by the closing of the normally open contact 1-2. When the normally closed contact 3-2 is opened, the feed lamp FL is turned off. The normally open contact 3-1 is closed, but the relay R5 does not operate.

4-2. The normally open contact 2-2 is closed, but this circuit is still in the non-operative state.

4-3. The normally open contact 2-4 is closed, but this circuit is still in the non-operative state.

4-4. The normally open contact 2-5 is closed, and the clutch $C_2$ for the preparatory and return cycle operate via the normally closed contact *a* of the switch $S_9$ and the normally closed contact 4-1*a* of the relay R4. This causes the moving frame 3 to begin to move in the left direction as a preparatory cycle.

The projection 116 at the underside of the moving frame 3 pushes the switch $S_9$ to open the normally closed contact *a* of the switch $S_9$ and stop the operation of the clutch $C_2$.

The standard point Sa of the moving frame 3 tops and waits at the position $P_9$.

5. The rotary drum 6 rotates, and with it, the cam plate M1 rotates and the projection 103 on it pushes the switch $S_{2\text{-}2}$ for roll paper supply.

5-1. The relay R6 operates through the contact 2-4, the switch $S_{2\text{-}2}$, and the normally closed contact *a* of the switch $S_{11}$. The normally open contact 6-1a is closed, and the relay R6 is self-maintained.

5-2. The clutch $C_4$ for roll paper supply which is connected in parallel with the relay R6 operates via the normally open contact 2-4, the switch $S_{2\text{-}2}$ and the normally closed contact *a* of the switch $S_{11}$. This leads to the driving of the rollers 30, 30' for feeding a roll of transfer paper (starging of the feeding of a roll of transfer paper).

6. The rotary drum and the cam plate continue their rotations, and the arcuate projection 104 of the cam plate M2 pushes the charging and exposing switch $S_3$. This leads to the lighting of the light source of the high voltage generating device HV of the charging devie and the exposing device.

7. The rotation of the rotary drum and the cam plate continues, and the projection 103 of the cam plate M1 pushes the switch $S_4$ for starting the exposure cycle.

By this, the following operations are performed.

7-1. The normally open contact *a* of the switch $S_4$ is closed, and the relay R4 operates via the contact 2-5, the contact $S_{9b}$, the contact $S_{4a}$, and the contact 2-2. The contact 4-2 is closed, and the relay R4 is self-maintained.

(7-2) The normally open contact 4-1*b* is closed, and the clutch $C_3$ for an exposing cycle operates via the contact 4-3 and the contact 4-1*b*. The moving frame begins to move in the right direction (starting of the moving exposure).

8. The rotary drum and the cam plate continue to rotate. The forward end 104 of the arcuate projection 104 of the cam plate M2 pushes the developing switch $S_5$.

The magnetic brush motor MM is driven via the normally open contact *b* of the switch $S_5$ (the start of the developing cycle).

9. The transfer paper *b* that has been fed actuates the transfer switch $S_6$. The normally open switch $S_6$ is closed, and the on-delay and off-delay relay R7 is actuated. By this, the normally open contact 7-1 is closed with a time lag, and the high voltage electric source HV of the transfer device operates (the starting of the operation of the transfer device).

10. When the rotary drum 6 continues to rotate and the forward end point S reaches the position $P_4$ for instructing the cutting operation, the switch $S_{11}$ for cutting a roll of transfer paper is actuated. This causes the normally closed contact a of the switch $S_{11}$ to open and the normally open contact *b* of the switch $S_{11}$ to be closed.

10-1. As a result of the closing of the normally open contact b of the switch $S_{11}$, the cutter solenoid L1 operates via the contact 6-1 and the contact *b* of the switch $S_{11}$ to operate the transfer paper cutting device 32 (the cutting of a roll of transfer paper).

Since the relay R6 is an off-delay relay, the contact 6-1 is retarded and then cut off. Accordingly, the operation of the cutter solenoid L1 is performed in a pulse-like fashion, and the cutting device 32 is returned to the original state.

By the operation of the switch $S_{11}$ in this manner, the self-maintenance by the relay R6 and the contact 6-1 is released. Thus, even when the switch $S_{11}$ is operated during the second rotation of the rotary drum 6, the cutting means 32 does not act. 10-2. By the opening of the normally closed contact a of the switch $S_{11}$, the clutch $C_4$ is opened, and the driving of the rollers 30, 30' stop. At the same time, the leading edge part of the transfer paper remaining after cutting stops and waits at the operative position $P_2$ of the cutting device 32 (the stopping of the feeding of a roll of transfer paper, and the stopping and waiting of the remaining roll of paper at the $P_2$ position).

11. The starting point Sa on the moving frame 3 reaches the ending position $P_{10}$ of the movement for an exposure cycle, and pushes the switch $S_{10}$. This causes the normally open switch $S_{10}$ to open, and the relay R2 is opened.

During the right direction movement of the moving frame, the projection 116 pushes the switch $S_8$, but since the normally closed contact 2-5 is closed, the relay $R_4$ and the moving clutch for the moving frame continue to operate.

The rear end of the arcuate projection 104 of the cam plate M2 is released from the switch $S_3$ in synchronization with the arrival of the standard point Sa at the position $P_{10}$.

11-1. By the opening of the normally closed switch $S_{10}$, the normally open contact 2-3 is opened, and the self-maintenance of the relay R2 is also released.

11-2. The normally open contact 2-2 is opened, and the relay R4 stops its operation. The normally open side contact *b* of the relay contact 4-1 is opened, and the clutch $C_3$ is opened (the end of the movement of the moving frame for an exposure cycle).

The normally closed side contact *a* of the relay contact 4-1 is closed, and the clutch $C_2$ for a return cycle operates via the normally closed switch $S_9$ and the contact 4-1*a* (the starting of the return cycle of the moving frame 3).

The normally open contact4 -3 provided in parallel with the normally closed switch $S_9$ is opened.

11-3. By the departing of the projection 104 of the cam plate M2, the switch $S_3$, and the light source 18 is turned off (end of the imagewise exposure). At the same time as this, the high voltage electric source HV sets in operation (the end of the charging of the photosensitive element).

11-4. The normally open contact 2-1 is opened, and this causes the stoppage of the operation of the start solenoid L2. The checking piece 118 of the restraint mechanism is returned to make it possible to engage the projecting lever 116 of the moving frame with the recess 117 (the preparation for the locking stop of the moving frame 3).

11-5. The operation of the relay R1 is stopped by the opening of the normally open contact 2-1. This causes the normally open contact 1-2 to be opened. The clutch $C_1$ continues its operation via the normally closed contact *b* of the switch $S_1$.

11-6. The normally open contact 2-4 is opened.

12. The rotary drum and the cam plates continue their rotations, and when the projection 104 of the cam plate M2 releases the pressing of the developing switch $S_5$, the normally open switch $S_5$ is opened. The operation of the magnetic brush drive motor MM is stopped.

13. When the rear end of the transfer paper passes the position of the transfer switch $S_6$, the transfer switch $S_6$ is opened. This causes the off-delay relay R7 to stop, and the normally open contact 7-1 is opened after delay. The high voltage electric source HV of the transfer device 37 is opened (the stopping of the operation of the transfer device 37).

The transfer paper on which the image has been transferred is separated from the drum 6, and the image is fixed by heating with the heating element 48. Then, it is discharged as a copy into outside the apparatus.

14. The standard point Sa on the moving frame 3 reaches the position $P_{12}$ of stopping the standard position of the moving frame, and the projection 116 actuates the switch $S_8$.

Thus, the normally closed switch $S_8$ is opened, and the clutch $C_2$ for returning is opened. At the same time, the projecting lever 116 of the moving frame 3 comes into engagement with the recess 117 of the checking element 118 to perform the locking and stopping of the moving frame (the end of the movement of the moving frame for a return cycle, and the stopping and locking of the moving frame).

15. The rotary drum 6 rotates through two turns, and with it, the cam plate rotates once. The projection 103 of the cam plate M1 pushes the switch $S_1$ for detecting the standard stopping position of the drum.

By this, the normally closed side contact *a* of the switch $S_1$ is opened, and the normally open side contact *b* of the switch $S_{11}$ is closed.

15-1. By the opening of the normally closed side contact $S_{1a}$, the clutch $C_1$ for driving the rotary drum 6 is opened to stop the rotary drum 6 (the stopping of the rotary drum).

15-2. By the opening of the normally closed side contact $S_{1a}$, the cleaning lamp (CL) and the cleaning motor (CM) stop.

15-3. By the opening of the normally closed contact $S_{1a}$, the relay $R_3$ is opened, and the normally closed contact 3-2 is closed. The feed lamp FL turns on to indicate that the next copying operation will be possible. The normally open contact 3-1 opens.

II. In the case of inserting a sheet-like transfer paper by hand

In this case, the following operation (3′) is performed instead of the operation (3), and the operation (5′) is performed instead of the operation (5). Otherwise, the copying operation is performed in the same way as in the case of automatic feeding of a roll of transfer paper.

(3′) The clutch $C_5$ for sheet feeding is normally actuated via the normally closed side contact *a* of the switch $S_7$, and as a result, the rollers 53, 53′ for sheet feeding are normally driven.

When a sheet-like transfer paper is inserted from an opening, the leading edge of it is nipped by a pair of rollers 53 and 53′, and the switch $S_7$ is opened, and the normally open side contact *b* of the switch $S_7$ is closed.

By the opening of the normally closed side contact $S_{7b}$, the clutch $C_5$ for paper feed becomes inoperative, and the sheet feed rollers 53 and 53′ stop (the stopping and waiting of the forward portion of the sheet-like transfer paper).

(5′) The rotary drum 6 and the cam plates continue their rotation, and the projection 103 of the cam plate M1 actuates the switch $S_{2\text{-}1}$ and closes the normally open switch $S_{2\text{-}1}$.

(5′-1) The relay R5 is operated via the normally open contact $S_{7b}$, the normally open switch $S_{2\text{-}1}$ and the normally open contact 3-1. The normally open contact 5-2 is closed, and the relay R5 is self-maintained. (5′-2) The normally open contact 5-1 is closed, and the clutch $C_5$ for sheet feeding operates again. The sheet feed rollers 53 and 53′ are driven (the start of the sheet feeding). (5′-3) The normally closed contact 5-3 is opened, to out off the passing of electricity to the roll feed clutch $C_4$ and the cutter solenoid L1. (5′-4) When the rear end of the sheet-like transfer paper passes the position of the switch $S_7$, the normally closed side contact *a* of the switch $S_7$ is closed.

When the switch $S_{2\text{-}1}$ and the switch $S_{2\text{-}2}$ are provided so that they are operated by the same cam plate, the sheet feeding initiation switch $S_{2\text{-}1}$ is provided in such a position that it is pushed by the cam plate earlier than the switch $S_{2\text{-}2}$ [see paragraph (5′-3) above].

III. In the case of reciprocal automatic copying using a roll of transfer paper

In this case, the operations (4′) and 4″) are performed respectively before and after the above operation (4), and the operation (15′) is performed instead of the operation (15). Otherwise, the copying operation is the same as above. (4′) The print count switches PC1 and PC2 are set at a desired number M ranging from 2 to infinity. This closes the normally open contact *b* of the switch PC1 and the normally open contact *b* of the switch PC2 are both closed. (4″) The relay R1 is self-maintained via the contact *b* of the switch PC1 and the normally open contact 1-3. Accordingly, the start solenoid L2 continues its operation unless the contact *b* of the switch PC1 is opened (continued unlocking of the moving frame).

Similarly, the normally open contacts 1-1 and 1-2 are always closed unless the contact *b* of the switch PC1 is opened.

Thus, the rotary drum drive clutch $C_1$ always continues its operation, and the rotary drum 3 continues its rotation (the continuation of the rotation of the drive drum). (15′) The rotary drum 6 rotates through two turns, and thus, the cam plate rotates once to actuate the switch $S_1$.

By this, the normally open side contact *b* of the switch $S_1$ is closed, and the relay R2 is operated via the contacts S1*b* and 1-1 and the switch $S_{10}$. The operations subsequent to the operation (4) are continued.

In parallel with the cutter solenoid L1, a counter coil PC is provided. Since a pulse for actuating the cutter solenoid L1 is given, the print counter switches PC1 and PC2 are returned to zero.

Thus when the both contacts *b* of the switches PC1 and PC2 are opened, the reciprocal copying is completed.

What we claim is:

1. An electrostatic photographic copying apparatus comprising:

an original-supporting device including a frame member with a transparent plate for holding an original to be copied;

a rotatable drum having a peripheral surface with an electrostatic photosensitive element disposed along at least a part there;

an image-forming device disposed adjacent the periphery of said drum for forming an electrostatic image corresponding to the original on said photosensitive element;

an optical device for projecting an image of the original onto the surface of the photosensitive element through an exposure opening included within said image-forming device;

an image-transfer device disposed downstream of said image-forming device along the periphery of said rotary drum; and a transfer paper forwarding device for feeding transfer paper into said image-transferring device, and for forwarding the transfer paper on which the image has been transferred to a discharge end through a desired processing device, wherein the distance from the leading boundary of that area of the surface of the photosensitive element on which an image is to be formed to the trailing boundary of said area is longer than the distance between the downstream end position of the transfer zone and a predetermined standard position upstream of the image-forming device in the rotating direction of the rotary drum;

said apparatus further characterized in that said apparatus includes control means wherein said controlling means includes:

means for rotating said rotary drum from an angular position at which the leading boundary of said area coincides with the standard position;

means for detecting when *n* cycles of the copying operation are completed during which time the rotary drum is rotated through two times *n* turns, wherein *n* is any integer, and wherein each cycle of the copying operation is started when the leading boundary reaches the upstream end position of the exposure opening during the first rotation of the rotary drum;

means for advancing the original-supporting device in one direction from the position at which a standard point thereon coincides with a position for initiating the exposure process; and means for reversing the direction of motion of the original-supporting device, after completing the movement for the exposure process to return the original-supporting device to a predetermined position.

2. The copying apparatus of claim 1, wherein said controlling means comprises a first control device for starting the rotation of the rotary drum at an angular position at which the leading boundary coincides with the standard position, and for stopping rotation of the drum after rotation through two times *n* turns from a position, wherein the leading boundary coincides with the standard position;

a second control device for starting the operation of each part of the image-forming device, before the leading boundary on the rotary drum reaches the upstream of each part of the image-forming device during the first rotation, said second control device including means for subsequently stopping the operation of each part of the image-forming device, after the trailing boundary has passed the downstream end of each part of the image-forming device;

a third control device for controlling said optical device so that when the leading boundary has reached the upstream end position of said exposing section in the first rotation, an image of an original is projected on the photosensitive element and the original is scanned; and a fourth control device for controlling said transfer paper forwarding device, so that the transfer paper is introduced into the transfer zone in synchronization with the arrival of the forward end point at the transfer zone during the first rotation.

3. The copying apparatus of claim 1, wherein said controlling means includes at least one cam plate, which is rotated once, while the rotary drum is rotated through two turns, and, wherein said controlling means further includes a plurality of switch means operable by the cam plate.

4. The copying apparatus of claim 3, wherein said cam plate is connected with said rotary drum by a belt.

5. The copying apparatus of claim 1, wherein said controlling means includes a device for moving said original-supporting device at a speed corresponding to the rotational speed of said rotary drum; a switch means for detecting the arrival of the leading boundary at the upstream end position of the exposure opening during the first rotation of the rotary drum for causing said moving device to start the movement of said original-supporting device for commencing the exposure process.

6. The copying apparatus of claim 1, wherein said controlling means includes a switch means for defining the terminating position of the movement of the original-supporting device for the exposure process, wherein said switch means is disposed along the moving path of said original-supporting device, and wherein said switch means further serves to stop and reverse the original-supporting device.

7. The copying apparatus of claim 6, wherein said switch means is positioned relative to the standard point, so that the moving distance includes during the exposure process of said original-supporting device said is equal to the sum of the desired maximum copyable length and the length of the exposing opening of said optical device in the moving direction of the original-supporting device.

8. The copying apparatus of claim 1, wherein said transfer paper forwarding device includes an inlet for insertion of separate sheets of copy paper;

synchronizing transfer rollers positioned downstream of said inlet;

a paper detecting switch located immediately downstream of said rollers;

means for engaging the copy paper with the photosensitive element on the rotary drum at the image transferring station;

means for advancing the copy paper at the same speed as the rotary drum;

switch means coordinated to be tripped upon arrival of the leading boundary of the photosensitive element on the rotary drum, said switch means being positioned at a location spaced from the image transferring station, a distance equal to the distance of the detecting switch from the transferring station; and means for stopping rotation of said synchronizing transfer rollers, when the leading edge of the copy paper engages said paper detecting switch, and for resuming rotation of said transfer rollers upon receiving a signal from said switch means associated with said rotary drum, wherein the leading edge of the copy paper arrives at the image transferring zone simultaneously with the leading boundary of the photosensitive element on the rotary drum.

9. In an electrostatic photocopying apparatus:

a drum, with a photosensitive element of a predetermined length, extending therearound, so as to encompass a first angle;

a carrier for moving an original image to be copied:

an imaging station;

means for focusing a portion of the original image onto the photosensitive element of the drum at said imaging station;

means for rotating the drum, past the imaging station to expose successive portions of said photosensitive element with said focusing means;

means for advancing said carrier relative to said imaging station from an initial position spaced from said imaging station to focus successive portions of said original on said photosensitive element;

means for coordinating the advance of the carrier with the rotation of the drum to duplicate the original image, as a charge image on the drum;

means for advancing copy paper to a transfer point, wherein said transfer point is juxtaposed with said drum and circumferentially spaced from said imaging station by a distance less than the length of photosensitive element and by an angle less than the angle encompassed by the photosensitive element;

means for coordinating the advancing means for copy paper, so that the copy paper arrives at the transfer station, when the charge image on the photosensitive element of the drum arrives at the transfer station;

means for returning said carrier to the initial position thereof, after one revolution of said drum during which a portion of the image is transferred to the copy paper; and means for subsequently advancing said carrier only after a subsequent revolution of said drum, in order that the entire length of said photosensitive element may engage said copy paper, the portion not engaging said copy paper on the first revolution engaging the copy paper on the second revolution.

10. The electrostatic photocopying apparatus of claim 9, wherein the drum stops and starts rotation, when a leading boundary of the photosensitive element is aligned with a starting station, which is disposed before said imaging station, and after said transfer station, in the direction of rotation of said drum.

11. The electrostatic photocopying apparatus of claim 10, wherein the photosensitive element extends partially around said drum, and the leading boundary of the photosensitive element is a leading edge of the element.

12. In the electrostatic photocopying apparatus of claim 9:

control means wherein said control means includes cam means for tripping a plurality of electrical switches, in sequence, to effect operation of said apparatus, and wherein drive means couples said cam means to said drum to rotate said cam means once for each two rotations of said drum.

* * * * *

UNITED STATES PATENT OFFICE

CERTIFICATE OF CORRECTION

Patent No. 4,012,138 Dated March 15, 1977

Inventor(s) Washio Takaji, et al.

It is certified that error appears in the above-identified patent and that said Letters Patent are hereby corrected as shown below:

Claim 1, line 8, delete "there", insert -- thereof --.

Claim 7, line 3, after "point" delete ",".

Claim 7, line 3, delete "moving distance includes", insert -- distance moved --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*